US007581414B2

(12) United States Patent
Kim et al.

(10) Patent No.: US 7,581,414 B2
(45) Date of Patent: Sep. 1, 2009

(54) DOOR FOR WASHING MACHINE AND DRYER AND WASHING MACHINE AND DRYER HAVING THE SAME

(75) Inventors: Jong Seok Kim, Changwon-shi (KR); Yang Hwan No, Changwon-shi (KR); Han Ki Cho, Changwon-shi (KR); Yeon Su Jung, Changwon-shi (KR); Jung Hoon Kang, Changwon-shi (KR); Myung Sik Park, Changwon-shi (KR); Young Hoon Ha, Masan-shi (KR)

(73) Assignee: LG Electronics Inc., Seoul (KR)

( * ) Notice: Subject to any disclaimer, the term of this patent is extended or adjusted under 35 U.S.C. 154(b) by 671 days.

(21) Appl. No.: 10/471,181

(22) PCT Filed: Jan. 9, 2003

(86) PCT No.: PCT/KR03/00032

§ 371 (c)(1),
(2), (4) Date: Sep. 9, 2003

(87) PCT Pub. No.: WO03/057971

PCT Pub. Date: Jul. 17, 2003

(65) Prior Publication Data

US 2004/0107741 A1 Jun. 10, 2004

(30) Foreign Application Priority Data

| | | |
|---|---|---|
| Jan. 9, 2002 | (KR) | 10-2002-0001294 |
| Jan. 9, 2002 | (KR) | 10-2002-0001295 |
| Jan. 9, 2002 | (KR) | 10-2002-0001298 |
| Jan. 10, 2002 | (KR) | 10-2002-0001528 |
| Nov. 28, 2002 | (KR) | 10-2002-0074960 |
| Nov. 28, 2002 | (KR) | 10-2002-0074962 |

(51) Int. Cl.
*D06F 39/14* (2006.01)

(52) U.S. Cl. ..... 68/196; 16/387

(58) Field of Classification Search ..... 68/196
See application file for complete search history.

(56) References Cited

U.S. PATENT DOCUMENTS

| | | | | |
|---|---|---|---|---|
| 1,228,257 | A * | 5/1917 | Stuck | 296/76 |
| 3,883,201 | A * | 5/1975 | Busoni | 49/167 |
| 5,375,297 | A * | 12/1994 | Lautenschlager et al. | 16/249 |
| 2002/0078525 | A1 * | 6/2002 | Hua et al. | 16/221 |
| 2003/0172692 | A1 * | 9/2003 | Hong et al. | 68/139 |

FOREIGN PATENT DOCUMENTS

| | | | |
|---|---|---|---|
| CH | 290826 | * | 5/1953 |
| DE | 21 49 092 | | 4/1972 |
| DE | 2149092 | * | 4/1972 |

(Continued)

OTHER PUBLICATIONS

International Search Report; Mar. 4, 2003; Austrian Patent Office; 2 pages.

*Primary Examiner*—Michael Barr
*Assistant Examiner*—Jason P Riggleman
(74) *Attorney, Agent, or Firm*—McKenna Long & Aldridge LLP

(57) ABSTRACT

A door for a washing machine or a dryer includes a frame having a system for opening/closing an opening provided for introducing laundry into a washing machine or a dryer, and a hinge assembly. The hinge assembly includes a bracket attached to an inside surface of a housing of the washing machine or the dryer, and a hinge arm. The hinge arm has a first member rotatably connected to the bracket, and a second member extended in succession to the first member and rotatably connected to the frame for being drawn to an outside of the washing machine and the dryer, thereby enabling the door to be rotated relative to the bracket and the hinge arm respectively, so as to be opened at a great angle.

45 Claims, 25 Drawing Sheets

FOREIGN PATENT DOCUMENTS

| | | | | |
|---|---|---|---|---|
| EP | 0 293 984 | A1 | | 12/1988 |
| EP | 293984 | A1 | * | 12/1988 |
| EP | 0 859 079 | A1 | | 8/1998 |
| EP | 0859079 | | | 8/1998 |
| EP | 859079 | A1 | * | 8/1998 |
| EP | 1 098 027 | A2 | | 5/2001 |
| GB | 2294698 | A | | 5/1996 |
| JP | 62-58597 | | | 4/1987 |
| JP | 2001-269498 | | | 10/2001 |
| KR | 1999-013266 | | * | 9/1997 |

* cited by examiner

DOOR FOR WASHING MACHINE AND DRYER AND WASHING MACHINE AND DRYER HAVING THE SAME

TECHNICAL FIELD

The present invention relates to a washing machine and dryer, and more particularly, to a door for a washing machine and dryer.

BACKGROUND ART

As known, a washing machine is provided with tub or drum mounted inside of the washing machine for washing laundry by turning the drum or the tub. Similar to such a washing machine, a dryer is also provided with a drum inside thereof for holding washed laundry, for supplying hot air thereto and drying the laundry.

The door is provided to a housing of the washing machine or the dryer, for introduction or taking the laundry into/out of the washing machine or the dryer. The door has a system for opening/closing of an opening in the housing in communication with the drum inside of the washing machine or the dryer. In more detail, the door is connected to a hinge assembly fitted to the housing, for rotating around the hinge assembly to open and close the opening.

However, since the door rotates on one hinge shaft of the hinge assembly, the door is opened only at a limited angle from the housing. Accordingly, the door is not convenient for the user to introduce and take out the laundry, actually. Moreover, it is liable that an excessive force is applied to the door during the introduction/taking into/out of the laundry, which reduces a lifetime of the hinge assembly and the door.

DISCLOSURE OF INVENTION

The object of the present invention designed for solving the foregoing problem is to provide a door which can be opened at a greater angle from the housing, and a washing machine and dryer having the door.

The object of the present invention can be achieved by providing a door for a washing machine and dryer including a frame having a system for opening/closing an opening provided for introducing laundry into a washing machine or a dryer, and a hinge assembly including a bracket attached to an inside surface of the washing machine or the dryer, and a hinge arm having a first member rotatably connected to the bracket, and a second member extended in succession to the first member and rotatably connected to the frame for being drawn to an outside of the washing machine and the dryer, thereby enabling to be rotated relative to the bracket and the hinge arm respectively, so as to be opened at a great angle.

The bracket includes a first end fixed to the housing, and a second end connected to the first member of the hinge arm. The bracket includes a guide slit for passing the second member. The housing includes a slit in communication to the guide slit formed at a position opposite to the guide slit.

The first member of the hinge arm includes a first end rotatably connected to the bracket, and a second end formed as one unit with the second member, the second end being opposite to the first end. The bracket includes a coupling part of the bracket and the first member includes a hub on the bracket, a hub at the first end of the first member, and a hinge shaft inserted into the hubs in common to connecting the hubs.

The first member is bent partly, preferably toward an inside surface of the housing.

The second member of the hinge arm includes a first end connected to the first ember as one unit, and a second end rotatably connected to the frame, the second end being opposite to the first end.

Preferably, the second member is inserted in the door, in more detail, the second member is connected to an inside surface of an outer frame of the door. A coupling part of the second member and the outer frame includes a hinge shaft on the second member, and a bracket attached to the inside surface of the outer frame for rotatably receiving the hinge shaft.

An inner frame joined with the outer frame has a cut away part for enabling the second member to make relative rotation with respect to the door, and the outer frame has a supplementary cut away part connected to the cut away part for enabling the second member to make relative rotation with respect to the door.

It is preferable that the second member is formed of a bar member having a width smaller than the first member, and the second member further includes a rib extended from the bar member.

A part of the frame adjacent to the second member is detachable for easy connection to the second member. According to this, the inner frame includes a main frame, and a subframe separable from the main frame, the subframe being adjacent to the connection part of the second member.

On the other hand, it is preferable that the hinge assembly further includes a damping means for absorbing an impact occurred at the door. The damping means supports the first member, elastically. The damping means is an elastic member adjacent to the first member attached to the housing so as to come into contact with the first member.

The damping means is a plate spring between the second member and the door frame. The damping means includes a plate spring fitted to the door frame adjacent to the second member, and a cam fitted to the second member so as to come into contact with the plate spring when the door is rotated.

Preferably, the hinge assembly includes one pair of first and second brackets, and one pair of first and second hinges rotatably connected to the brackets. In this case, it is preferable that the bar members of the second members of the first and second hinge arms are spaced away outwardly from longitudinal center lines of the first members.

Preferably, the hinge assembly further includes connection means for restraining the first and second hinge arms to each other.

The connection means is a plate member connecting the first members of the first and second hinge arms. The connection means may be a rod for connecting the hinge shafts formed on the second members of the first and second hinge arms.

In another aspect of the present invention, there is provided a washing machine including a housing, a tub in the housing for storage of washing water, a drum rotatably mounted in the tub for washing laundry, a door including a frame having a system for opening/closing an opening provided for introducing the laundry into the drum, and a hinge assembly having a bracket attached to an inside surface of the housing, and a hinge arm with a first member rotatably connected to the bracket, and a second member extended in succession to the first member and rotatably connected to the frame for being drawn to an outside of the housing, thereby enabling to be rotated relative to the bracket and the hinge arm respectively, so as to be opened at a great angle.

In further aspect of the present invention, there is provided a dryer including a housing, a drum rotatably mounted in the housing for drying laundry, a heating device mounted in the housing for supplying hot air to the drum, and a door including a frame having a system for opening/closing an opening provided for introducing the laundry into the drum, and a hinge assembly having a bracket attached to an inside surface of the housing, and a hinge arm with a first member rotatably connected to the bracket, and a second member extended in succession to the first member and rotatably connected to the frame for being drawn to an outside of the housing, thereby enabling to be rotated relative to the bracket and the hinge arm respectively, so as to be opened at a great angle.

Thus, the door of the present invention can be opened at a great angle in the washing machine and the dryer, permitting the user to introduce, or take laundry into/out of the washing machine or dryer.

BRIEF DESCRIPTION OF DRAWINGS

The accompanying drawings, which are included to provide a further understanding of the invention, illustrate embodiments of the invention and together with the description serve to explain the principles of the invention.

In the drawings.

BEST MODE FOR CARRYING OUT THE INVENTION

Reference will now be made in detail to the preferred embodiments of the present invention, examples of which are illustrated in the accompanying drawings. In describing the embodiments of the present invention, the same parts will be given the same names and reference symbols, and iterative description of which will be omitted.

Figure 1:
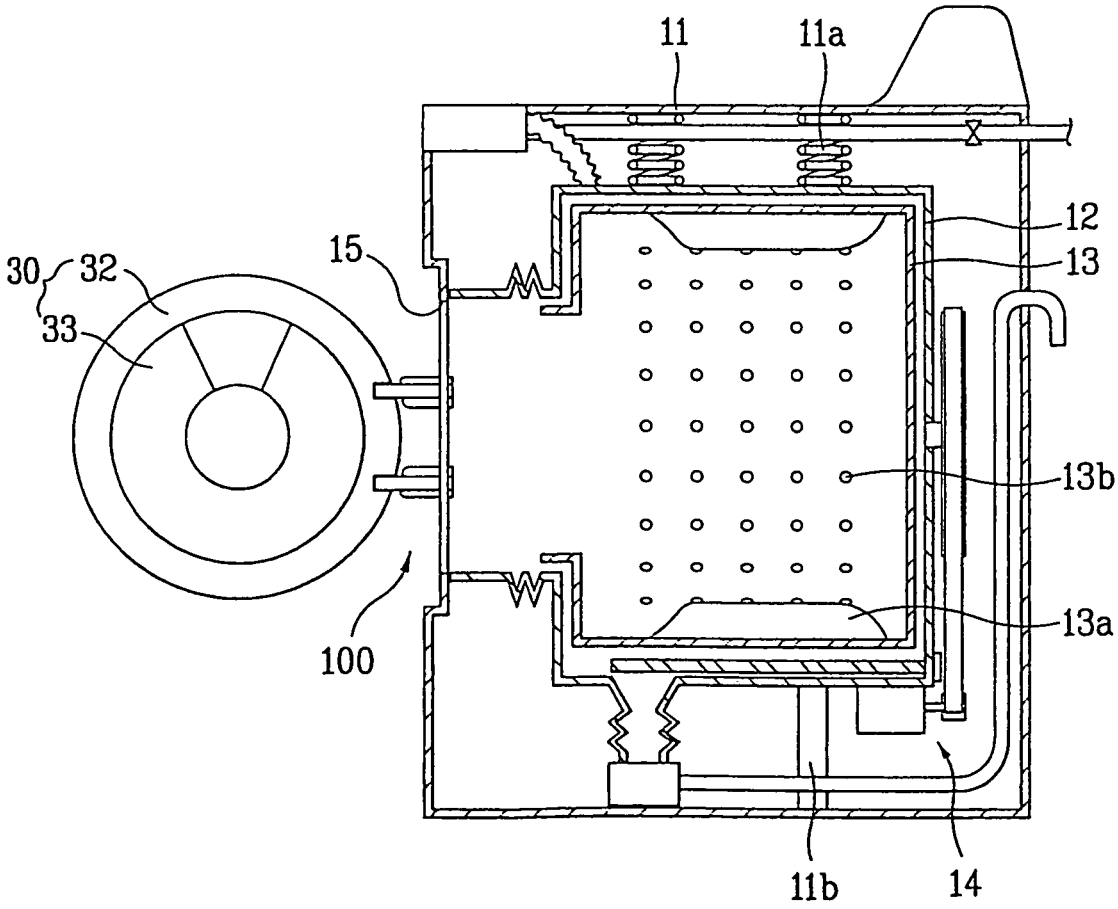
FIG. 1 illustrates a side section of a washing machine in accordance with a preferred embodiment of the present invention.
Figure 2:
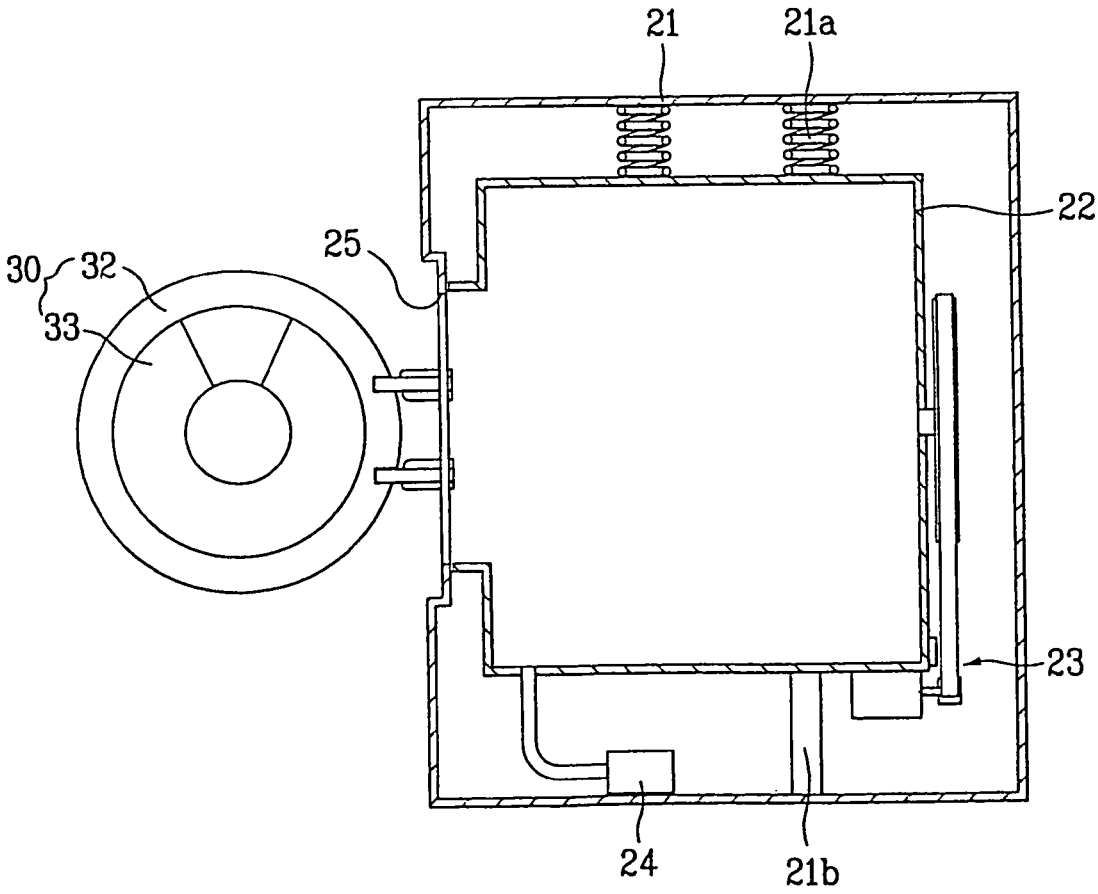
FIG. 2 illustrates a side section of a dryer in accordance with a preferred embodiment of the present invention.

FIG. 1 illustrates a side section of a washing machine in accordance with a preferred embodiment of the present invention, and FIG. 2 illustrates a side section of a dryer in accordance with a preferred embodiment of the present invention, referring to which the washing system of the present invention will be described.

Referring to FIG. 1, the washing machine of the present invention includes a housing 11, and a tub 12 and a drum 13 mounted inside of the housing 11. The housing is designed such that various components are fitted therein and protected by the housing. The tub 12 stores washing water to be ready to supply the washing water to an inner tub during washing constantly. The tub 12 is elastically fixed to an inside of the housing 11 with damping member 11*a* and 11*b*. The drum 13 holds the laundry, and is rotatably mounted inside of the tub 12. The drum 13 has a plurality of through holes 13*b* for flow of the washing water from the tub 12. There are a plurality of baffles 13*a* attached on an inside surface of the drum 13 for mixing the laundry well. In the meantime, there is a driving part 14 adjacent to the tub 12 for providing rotating power to the drum 13. In general, the driving part 14 includes a motor, a driving shaft, and a clutch or belt for connecting the motor and the driving shaft, and the driving shaft is connected to the drum 13 through the tub 12.

Referring to FIG. 2, the dryer of the present invention includes a housing 21, and a drum 22 inside of the housing. The drum 22 holds the laundry, and is rotatably mounted in the housing 21. The drum 12 is elastically fixed to an inside of the housing 21 with damping members 21*a* and 21*b*. There is a driving part 23 for providing rotating power to the drum 13, and has a structure similar to the driving part 14 of the washing machine. Finally, there is a heating device 24 for producing hot air and supplying to an inside of the drum 22 for drying the laundry.

Figure 4A:
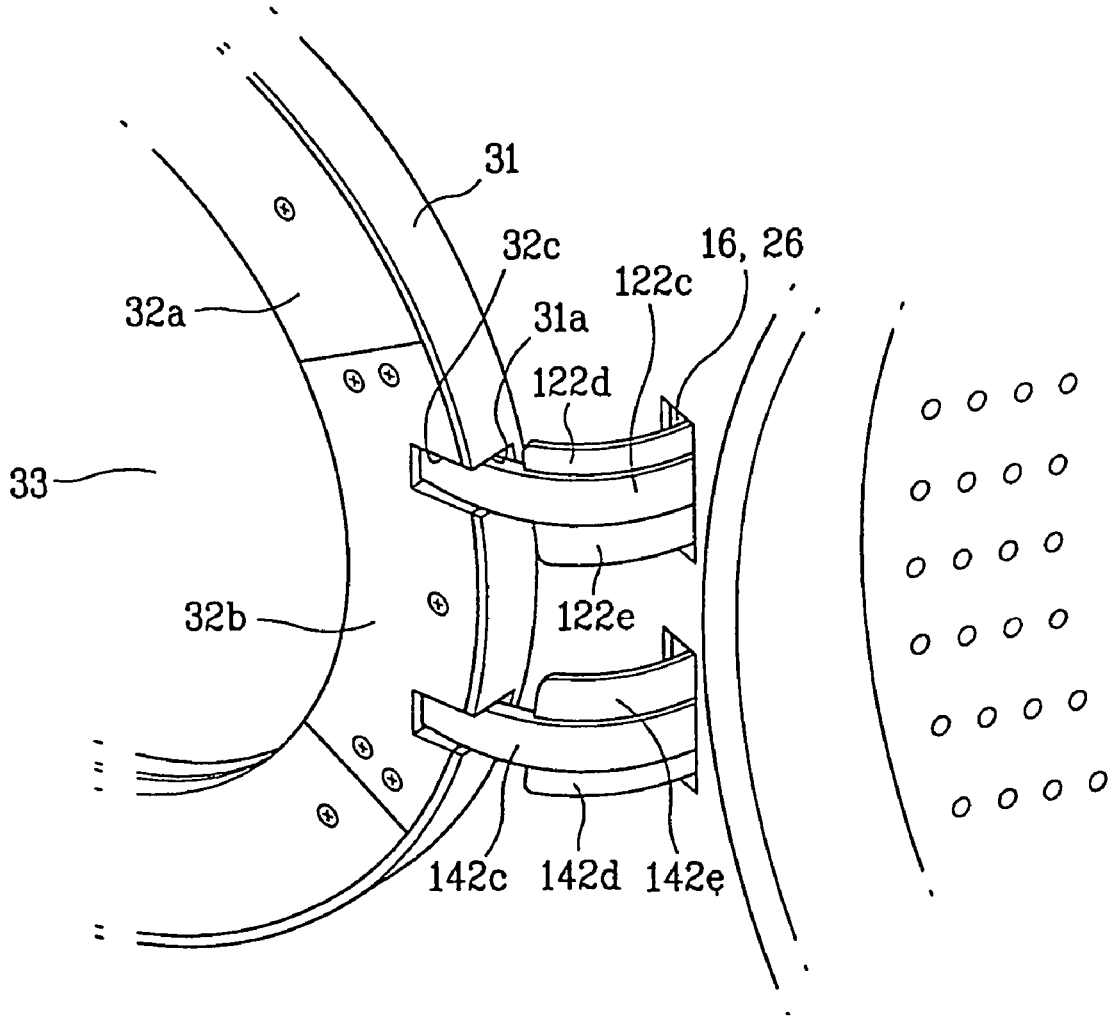
FIGS. 4A and 4B illustrate partial enlarged perspective views each showing a coupling part of the hinge assembly and the door.
Figure 4B:
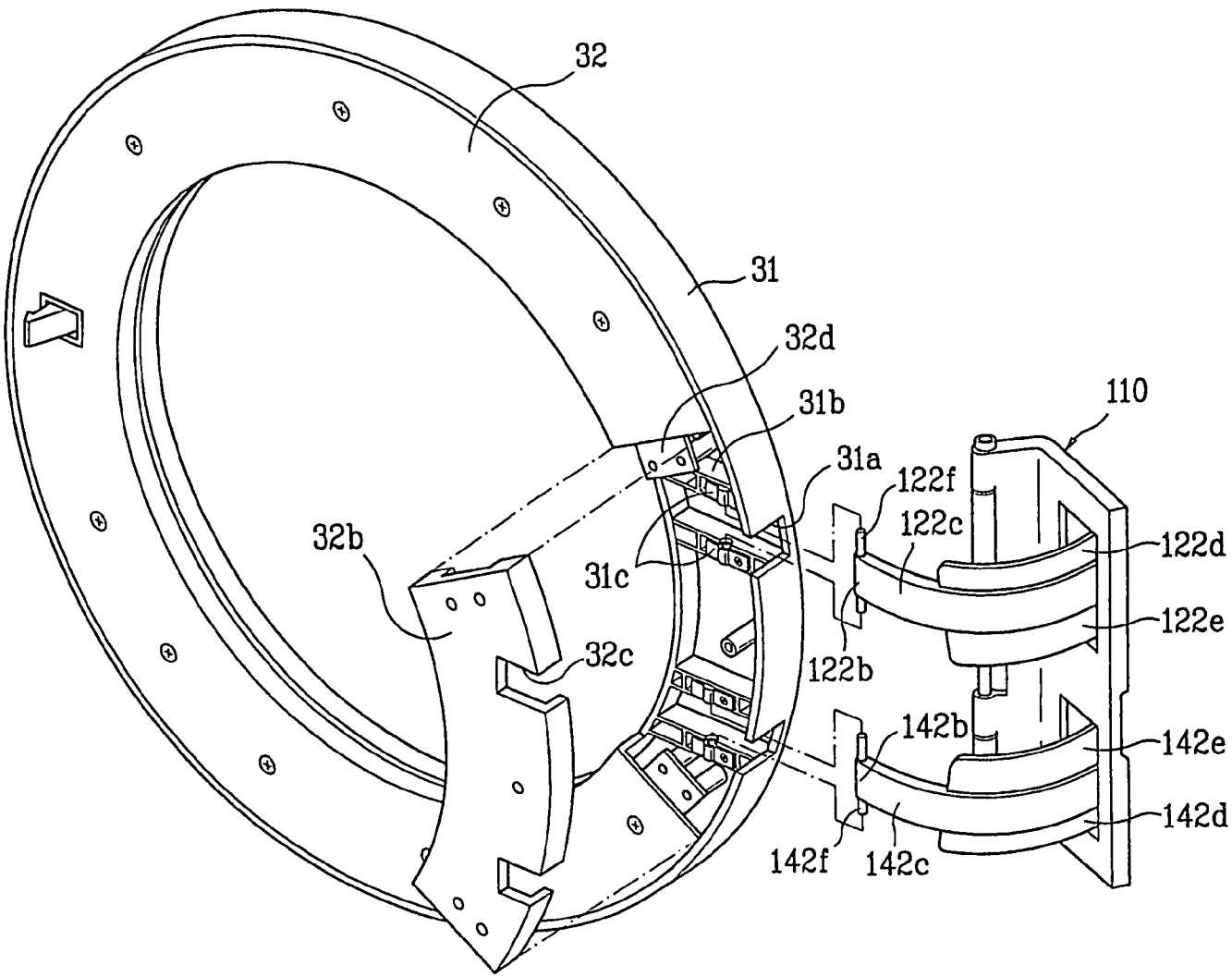

Both the washing machine and the dryer have a door 30 for introducing or taking out the laundry. As shown in FIG. 1 or 2, the door 30 has a system for opening or closing an opening 15 or 25 in communication with the drum 13 or 22. That is, the laundry is introduced into the washing drum 12 through the opening 15 after opening the door 30, and the washing and spinning are carried out by rotating the washing drum 12 after closing the door 30. The laundry washed in the washing machine is introduced into the drying drum 22 through the opening 25 after opening the door 30, dried by using hot air from the heating device 24 after closing the door 30. In more detail, as shown in FIGS. 4A and 4B, the door 30 includes an outer frame 31 and an inner frame 32 fitted to the outer frame 31. There is a door glass 33 between the outer frame 31 and the inner frame 32 for looking inside of the drum 13 or 22. There are hooks at one side of the door 30, and the housing 11 or 21 includes a fastening mechanism for accommodating the hooks. When the door 30 is closed, the hook is engaged with the fastening mechanism for preventing the door 30 from opening while the washing machine or the dryer is in operation. The door 30 is hinged on the housing 11 or 21 with the hinge assembly 100 actually, for swing open/shut the opening 15 or 25. The hinge assembly 100 will be described in more detail.

Figure 3A:
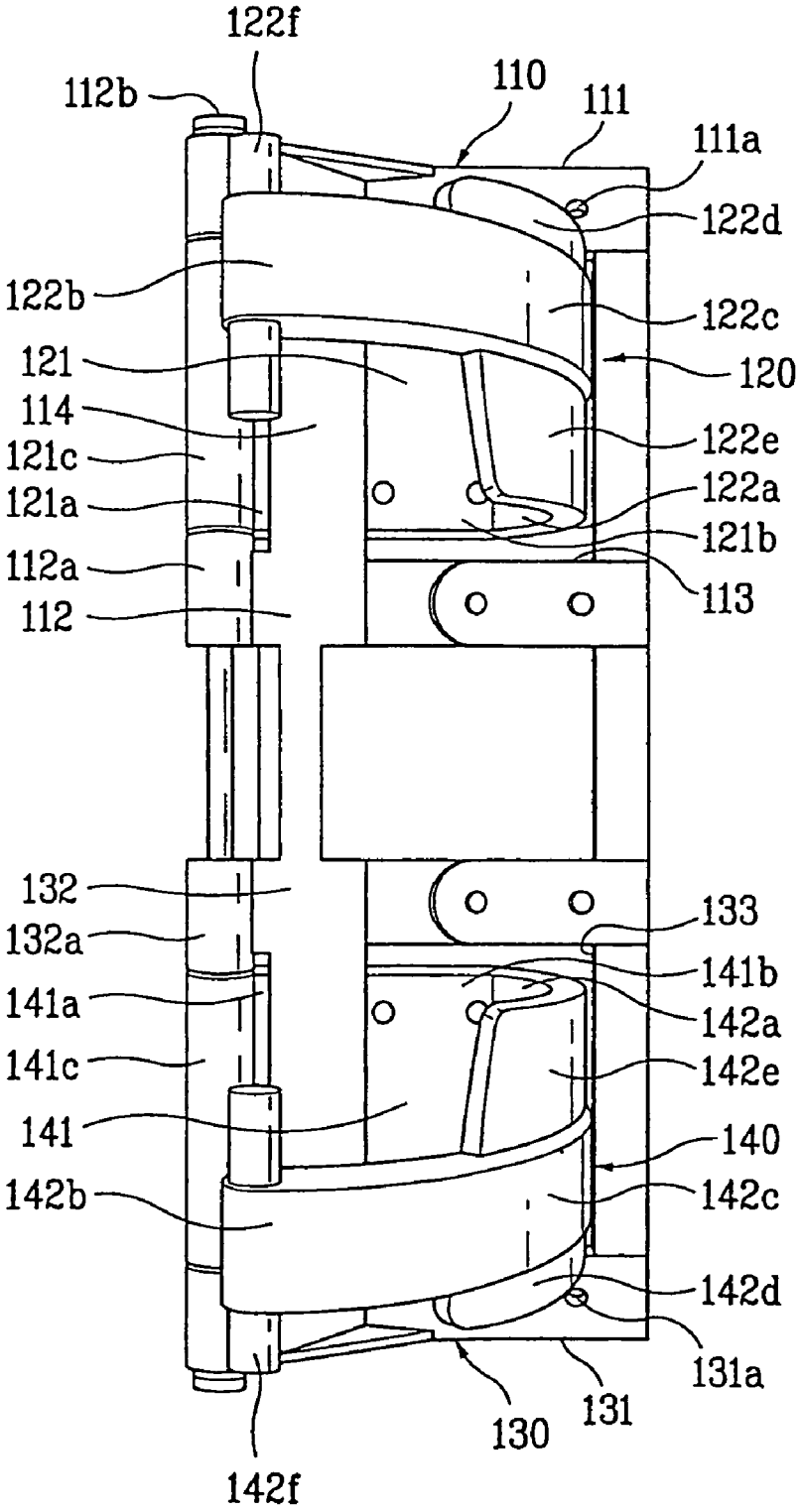
FIG. 3A illustrates a front view of a hinge assembly for a door of washing machine and dryer in accordance with a preferred embodiment of the present invention.
Figure 3B:
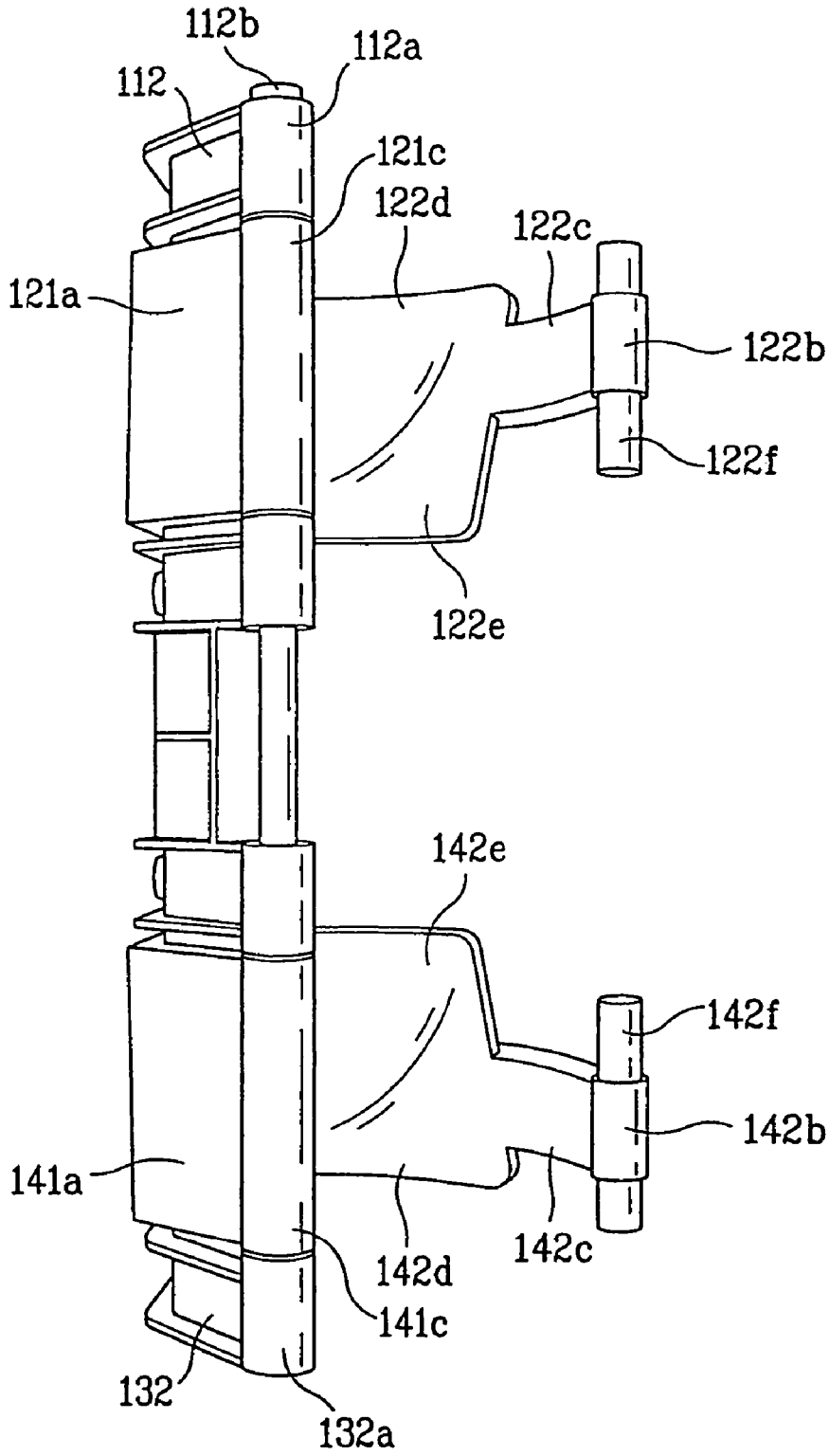
FIG. 3B illustrates a side view of the hinge assembly in FIG. 3A.
Figure 3C:
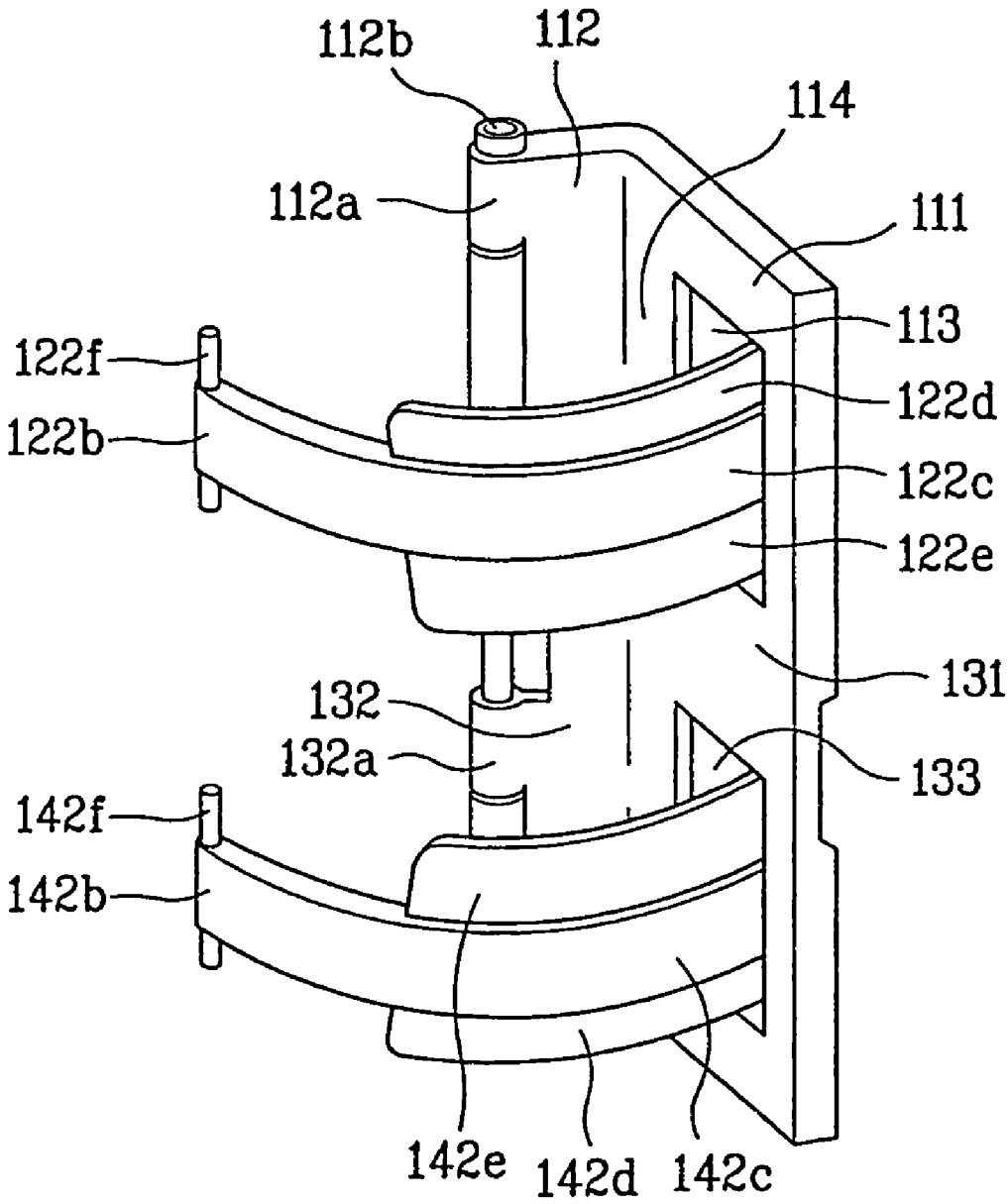
FIG. 3C illustrates a perspective view of the hinge assembly in FIG. 3A.

FIGS. 3A~3C illustrate hinge assemblies for a door of washing machine and dryer in accordance with a preferred embodiment of the present invention, and FIGS. 4A and 4B illustrate partial enlarged perspective views each showing a coupling part of the hinge assembly and the door.

The hinge assembly 100 includes a bracket 110 attached to an inside surface of the housing 11 or 21 and hinge arms 120 each rotatably connected to the door 30. The hinge assembly 100 is shown in detail in FIGS. 5A~11D, with reference to which the hinge assembly 100 will be described, together with FIGS. 3A~4B.

Basically, the bracket 110 rotatably supports the hinge arm 120. In detail, the bracket 110 includes a first end part 111 attached to an inside surface of the housing 11 or 21, and a second end part 112 connected to the hinge arm 120. The first end part 111 has holes 111*a* for fastening to a fastening member of the housing 11 or 21. Moreover, as shown in FIGS. 11A~11D, the bracket 110 has slots 113 for drawing out the hinge arms 120 positioned together with the bracket 110 from an inside of the housing 11 or 21 to an outside of the housing 11 or 21 partly. Along with this, the housing 11 or 21 also has slots 16 or 26 in communication with the slot 113. The slots 113, 16, and 26 are positioned adjacent to the opening 15 or 25. That is, a part of the hinge arm 120 is drawn to the outside of the housing through the slots 113, 16, and 26 during rotation, and guided by the slots 113, 16 and 26 during the hinge arm 120 is drawn. According to this, the hinge arm 120 can be connected to the door 30 on outside of the housing, to rotate and open the door 30 as the hinge arm 120 is drawn to outside of housing.

The hinge arm 120 includes a first member 121 rotatably connected to the bracket 100, and a second member 122 connected from the first member 121 in succession and rotatably connected to the door 30. The first member 121 is connected to the bracket 100 at a part inside of the housing 11 or 21, and the second member 122 is connected to the door 30 at a part outside of the housing 11 or 21 (see FIGS. 11A~11D).

The first member 121 includes a first end 121*a* rotatably connected to the bracket 110, and a second end 121*b* opposite to the first end 121*a*. The first end 121*a* is connected to a second end part 112 of the bracket 110, actually. In more detail, the second end part 112 of the bracket 110 has a hub 112*a*, and similar to this, the first end part 121*a* of the first member 121 also has a hub 121*c*. The hubs 112*a* and 121*c* are coupled with a first hinge shaft 112*b*. The second end 121*b* is connected with the second member 122 as one unit.

As shown, rotation of the first member 121 is limited as rotation of the first member 121 is stopped by a part 114 of the bracket 110. Or, even if the first member 121 not stopped by the bracket 110, the first member 121 is stopped by an inside of the housing 11 or 21 such that the first member 121 has a limited range of rotation. Accordingly, it is preferable that the first member 121 is a flat member for making a stable stop at the housing 11 or 21 or the bracket 110.

In the meantime, for smooth rotation of the hinge arm 120 and the door 30, basically it is required that the first member 121 is long appropriately. On the other hand, the hinge arm 120 (i.e., the first member) rotates centered on the hinge shaft 112*b* together with the door 30. A moment of the rotation is substantially depends on a length of the first member 121 and a force pulling the door 30. Since a moment required for rotating the door 30 is constant, the greater the length of the first member 121, the smaller the force required for rotating the door 30. Owing to those reasons, though it is favorable that the length of the first member 121 is the greater, the long first member 121 may interfere the housing 11 or 21 or other adjacent components during the rotation. Therefore, it is preferable that the first member 121 is bent partly toward the housing 11 or 21. (see FIG. 11A). Such a bent first member 121 minimizes interference with the adjacent components while the length of the first member 121 is increased.

The second member 121 includes a first end part 122*a* connected to the second end part 121*b* of the first member and a second end part 122*b* opposite to the first end part 122*a*. The second end part 122*b* is rotatably connected to the door 30, more precisely to the frame 31 and 32. Therefore, the second member 122 is always projected to an exterior through the slots 113, 16, and 26 partly, and drawn until the first member 121 is stopped by the bracket 110 in opening the door 30. In more detail, the second member 122 is extended from the first member 121 vertical to the adjacent housing 11 or 21 for being drawn through the slots 113, 16, or 26. It is preferable that the second member 122 has a curvature for being drawn smoothly. Along with this, it is required that the second member 122 is curved in a direction of opening of the door 30 for increasing an angle of opening of the door 30.

The second member 122 may be connected to, for an example, an outside part of the door 30. That is, referring to FIGS. 4A and 4B, a bracket may be attached to the inner frame 32, and the second end part 122*b* of the second member 122 may be connected to the bracket. However, the attachment of the bracket to the door 30 results in an actual increase of a thickness of the door 30, with a possibility that the door 30 interferes with the hinge arm 120 or the housing 11 or 21. Therefore, as shown in FIGS. 4A and 4B, it is preferable the second member 122 in provided inside of the door 30. As a result, since no bracket is used, the thickness of the door 30 becomes thin, and no interference is occurred during rotation. Moreover, since the bracket is not exposed to an exterior, an appearance of the door 30 looks good. In more detail, as shown in FIG. 4B, the second member 122 is connected to the outer frame 31 of the door. The second end 122*b* has a second hinge shaft 122*f* formed thereon, and a bracket 31*c* is attached to an inside surface of the outer frame 31 for rotatably receiving the second hinge shaft 122*f*. It is preferable that the second member 122 is spaced a distance away from the inside surface of the outer frame 31. The spaced distance permits the door 30 to rotate at a greater angle with respect to the second member 122. For this, there are ribs 31*b* on the inside surface of the outer frame 31, to which the bracket 31*c* is attached.

For rotating the door 30 relative to the second member 122 centered on the hinge shaft 122*f*, it is required that parts of the frames 31 and 32 in the vicinity of the second member 122 are removed. Accordingly, the inner frame 32 is cut away to form a cut away part 32*c* for the second member 122. It is preferable that the outer frame 31 is also cut away to form a supplementary cut away part 31*a* connected to the cut away part 32*c*. However, when a width of the second member 122 is great, it is required that the cut away part 31*a* and 32*c* are also large, to reduce strengths of the frames 31 and 32. Accordingly, it is favorable that the second member 122 includes a bar member 122*c* having a width at least smaller than the width of the first member 121. The bar member 122*c* permits to minimize sizes of the cut away part 31*a* and 32*c* such that strengths of the frames 31 and 32 are not reduced. Opposite to this, since the bar member 122*c* has a smaller section, it is possible that the bar member 122*c* is weak. For reinforcing the strength of the second member 122, the second member 122 further includes ribs 122*d* and 122*e* extended from the bar member 122*c* in a direction of the width. As described, the ribs 122*d* and 122*e* are not extended to an inside of the frames 31 and 32 for minimizing the cut away parts 31*a* and 32*c*. Instead, the ribs 122*d* and 122*e* are extended along the bar member 122*c* such that the ribs 122*d* and 122*e* have a space from the door frames 31 and 32. It is preferable that the ribs 122*d* and 122*e* have a long extension adjacent to the door 30 as far as possible for compensating strength of the bar member 122*c*. Therefore, ends of the ribs 122*d* and 122 adjacent to the door 30 have forms in conformity with an outer form of the door 30, to have a slope according to a curvature of the door 30.

Since the second member 122 is attached to the inside surface of the outer frame 31, it is required that the second member 122 is assembled together with the outer, and inner frames 31 and 32, the door glass 33. However, since the door glass 33 is heavy, the assembly is difficult and causes many mistakes. Moreover, if it is intended to detach the door 30 for replacement and maintenance, when it is required to separate an entire inner frame 32 is separated from the outer frame 31, the separating work is cumbersome. Therefore, it is preferable that a part of the inner frame 32 adjacent to the second member 122 is separable. That is, as shown in FIG. 4B, the inner frame 32 includes a mainframe 32*a*, and a subframe 32*b* separable from the mainframe 32*a*. For firm connection of the mainframe 32*a* and the subframe 32*b*, the mainframe 32*a* has extensions 32*d* from both ends of the mainframe 32*a* to which both ends of the subframe 32*b* are fastened. If it is intended to assemble the door, the mainframe 32*a*, the outer frame 31 and the door glass 32 may be assembled a first, the second member 122 is attached to such a semi-assembly, and the subframe 32*b* may be fitted to the outer frame 31, finally. According to this, the door 30 can be connected to the hinge assembly 100 easily. Moreover, by separating the subframe 32*b* only, the entire door 30 can be separated from hinge assembly 100, i.e., the second member 122, conveniently.

In the meantime, a sudden shut off of the door 30 gives an impact to the housing 11 or 21. The impact not only reduces a lifetime of the door 30 itself, but also causes faults on sensitive electronic components inside of the washing machine or the dryer. Moreover, when the door 30 is opened suddenly, the door 30, i.e., the outer frame 31, hits the housing 11 or 21 and the second member 122, as the door 30 swings excessively. In this case, not only an impact is given to the washing machine and the dryer, but also the housing 11 or 21 and the hinge assembly suffer from damage. Therefore, in order to absorb the impact occurred during handling of the door 30, the hinge assembly includes damping means 210, 220, 230 and 240.

Figure 5A:
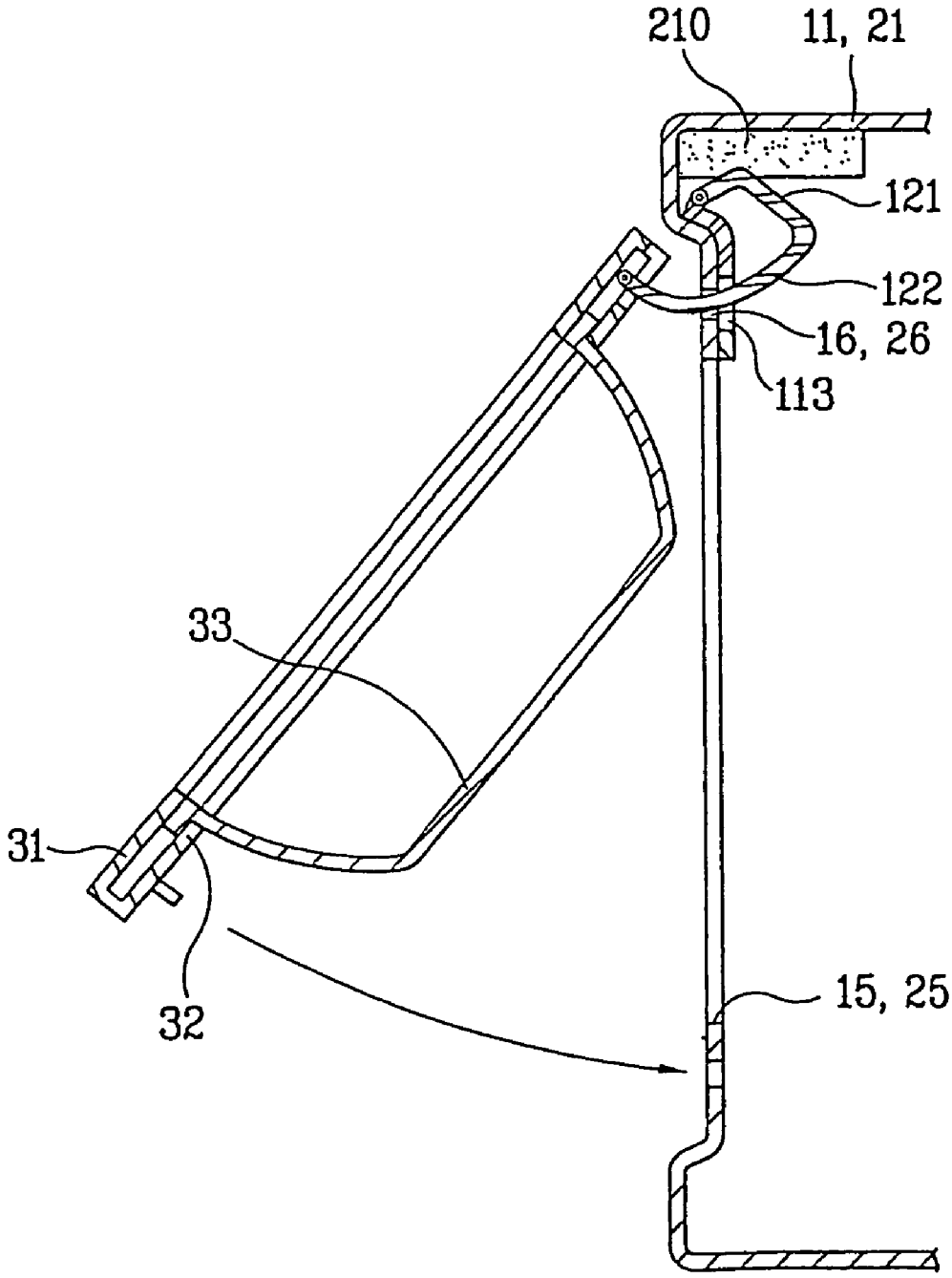
FIGS. 5A and 5B illustrate partial sections each showing a first embodiment damping means of the washing machine and dryer of the present invention.
Figure 5B:
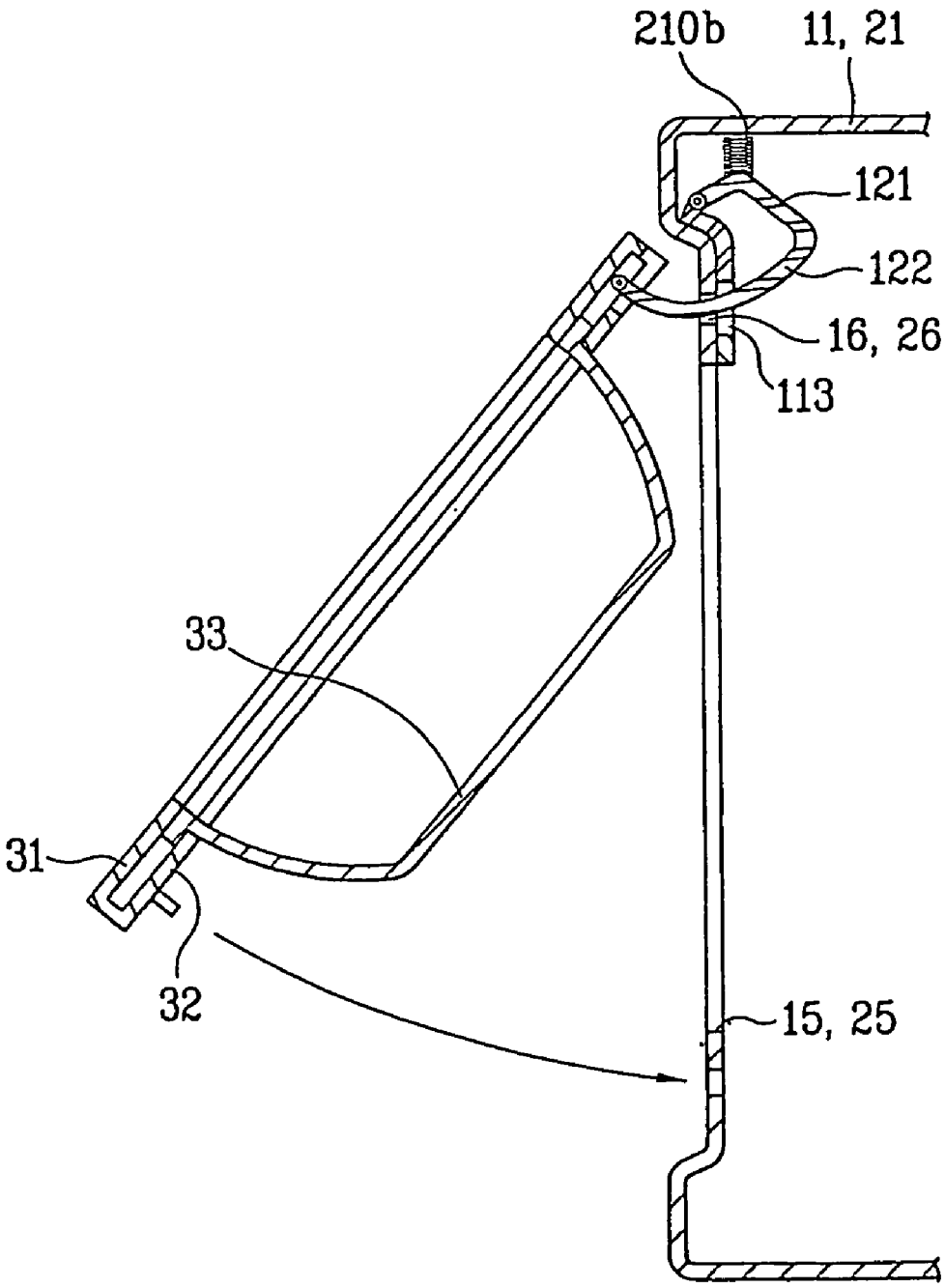
Figure 6A:
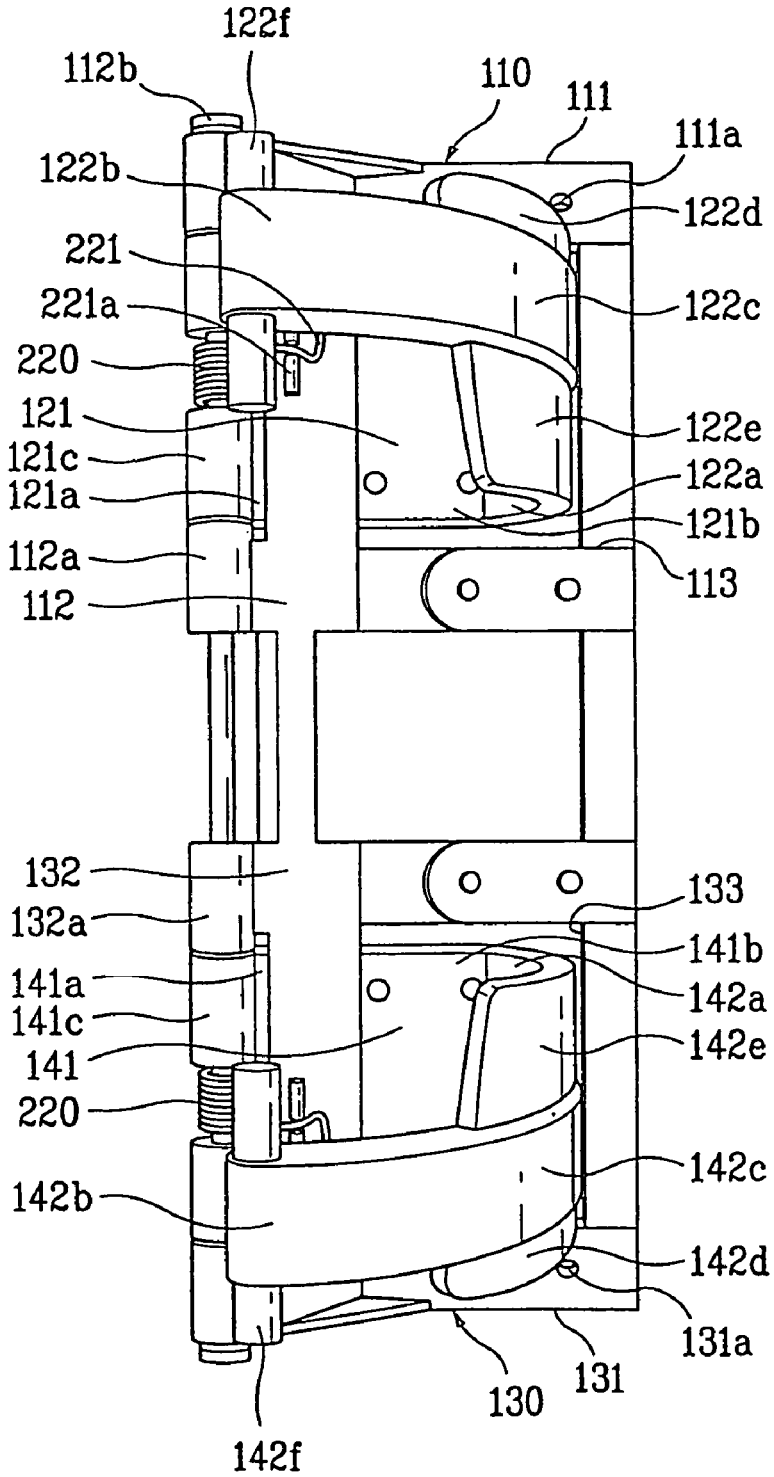
FIGS. 6A and 6B illustrate a front view and a side view each showing variations of the first embodiment damping means in FIGS. 5A and 5B.
Figure 6B:
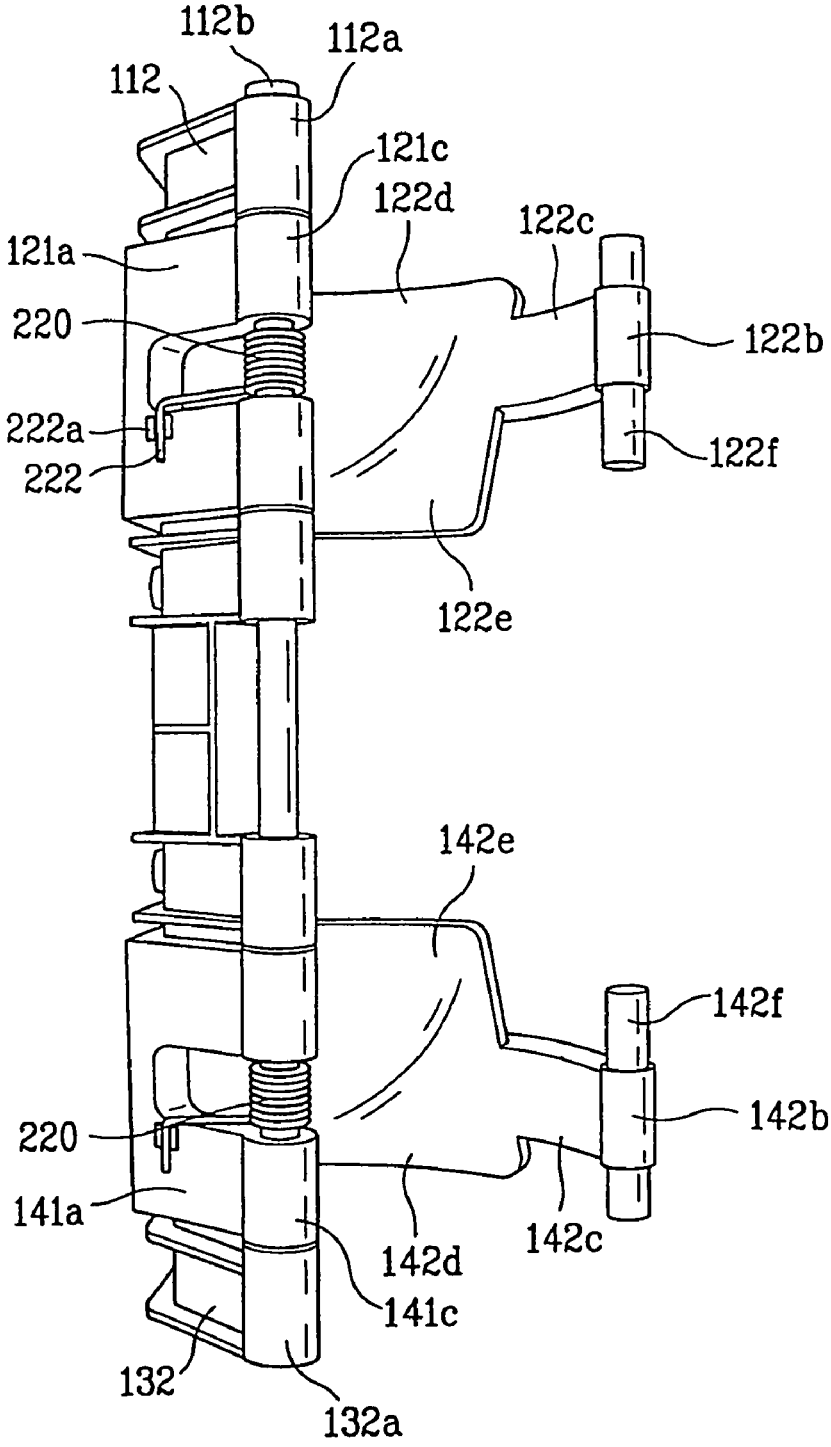

FIGS. 5A~6B illustrate first embodiment of the damping means. As shown, the first embodiment damping means elastically supports the first member 121 for absorbing an impact occurred when the door 30 is closed. At first, referring to FIGS. 5A and 5B, the damping means may be an elastic member 210 attached to an inside surface of the housing 11 or 21 so as to be in contact with the first member 121. The elastic member 210 may be a sponge or rubber member 210 shown in FIG. 5A, or a compression spring 210*b* shown in FIG. 5B, and may be any material or form as far as the material is elastic. Or, as shown in FIGS. 6A and 6B, the damping means may be a spring 220 provided to a coupling part of the first member 121 and the bracket 110. In more detail, the spring 220 is disposed in a cut away part of the first member 121 and the first hinge shaft 112*b* is inserted in the spring 220 together with the hubs 112*a* and 121*c*. As shown in FIG. 6A, one end 221 of the spring 220 is positioned in a seat 221*a* in the bracket so as to be supported on the bracket 110. The other end 222 of the spring 220 is positioned in a seat 222*a* in the first member so as to be supported on the first member 121.

In this first embodiment, the elastic member 210*a* or 210*b* in FIG. 5A or 5B is compressed when the door 30 is closed, and restored when he door 30 is opened. On the other hand, when the door 30 is opened, the other end 222 of the spring 220 in FIGS. 6A and 6B moves away from the one end 221 on the bracket 210, gradually. At the end, the spring 220 is twisted as the door 30 is opened, and restored as the door 30 is closed. Accordingly, even if the door 30 is closed suddenly, the impact is absorbed by the damping means 210 or 220 so as not to be transmitted to the washing machine or the dryer. Moreover, since the damping means 210 or 220 pushes the door 30 as the damping means 210 or 220 is restored, the door 30 can be opened, smoothly.

Moreover, referring to FIGS. 7A~8C, a second embodiment damping means elastically supports the second member 122 for absorbing an impact occurred during opening of the door 30. At first, referring to FIGS. 7A and 7B, the second embodiment damping means may be a plate spring 230 between the second member 122 and the outer frame 31. That is, the plate spring 230 is positioned directly under the second member 122 connected to the outer frame 31. The plate spring 230 can be fastened to a boss 231 on the outer frame 31 with a fastening member 232. Alternatively, as shown in FIGS. 8A and 8B, the second embodiment damping means 240 includes a plate spring 241 on the outer frame 31, and a cam 242 on the second member 122. The plate spring 241 is fitted parallel and adjacent to the second member, more precisely, to the bar member 122*c*. The plate spring 241 is fastened to a boss 241*a* on the outer frame 31 with a fastening member 241*b*. The cam 242 is fixed to an extended part of the hinge shaft 122*f* such that the cam 242 is brought into contact with the plate spring during rotation of the door 30.

Figure 7A:
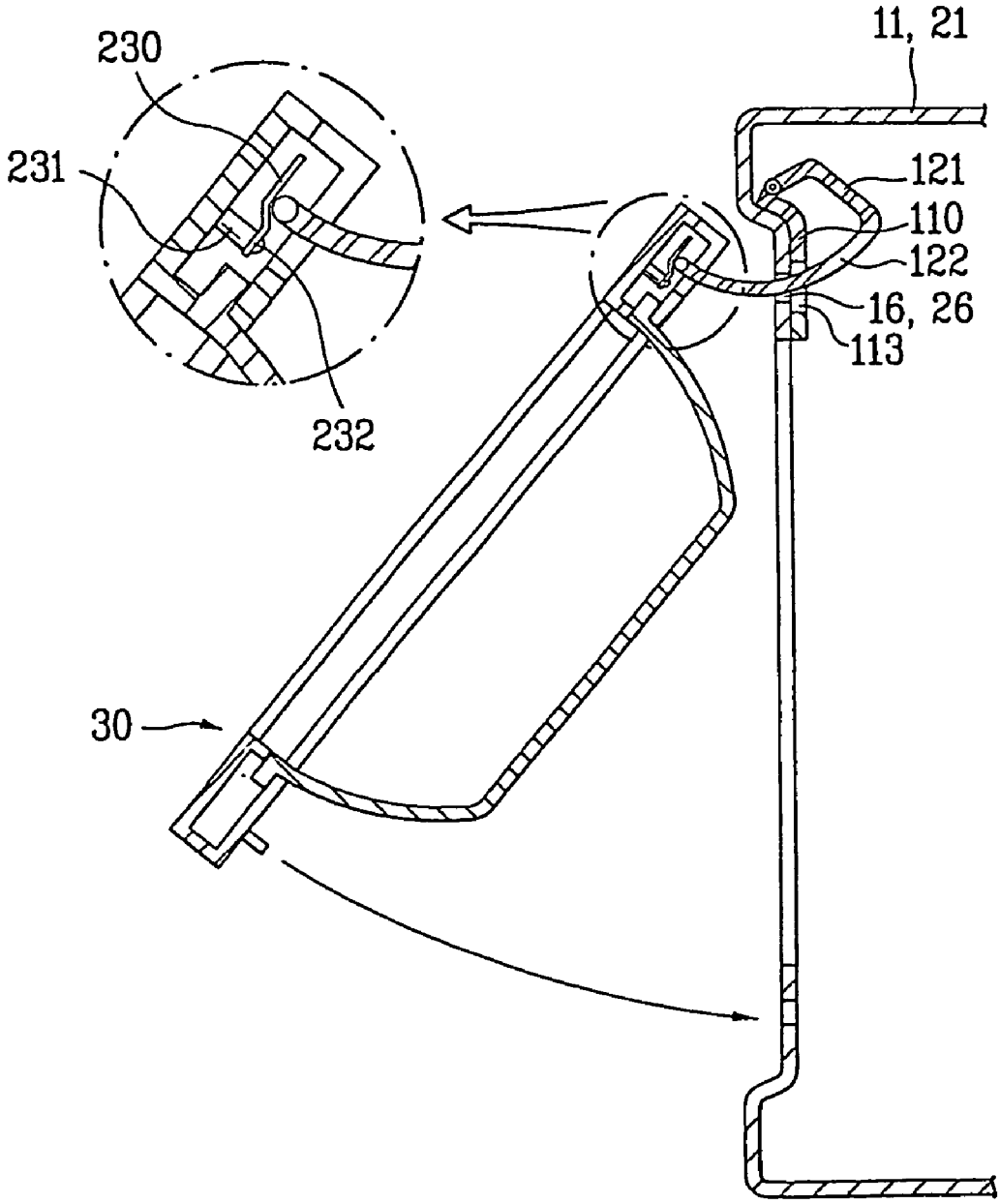
FIGS. 7A~7C illustrate partial sections and a perspective view each showing second embodiment damping means of the door for washing machine and dryer of the present invention.
Figure 7B:
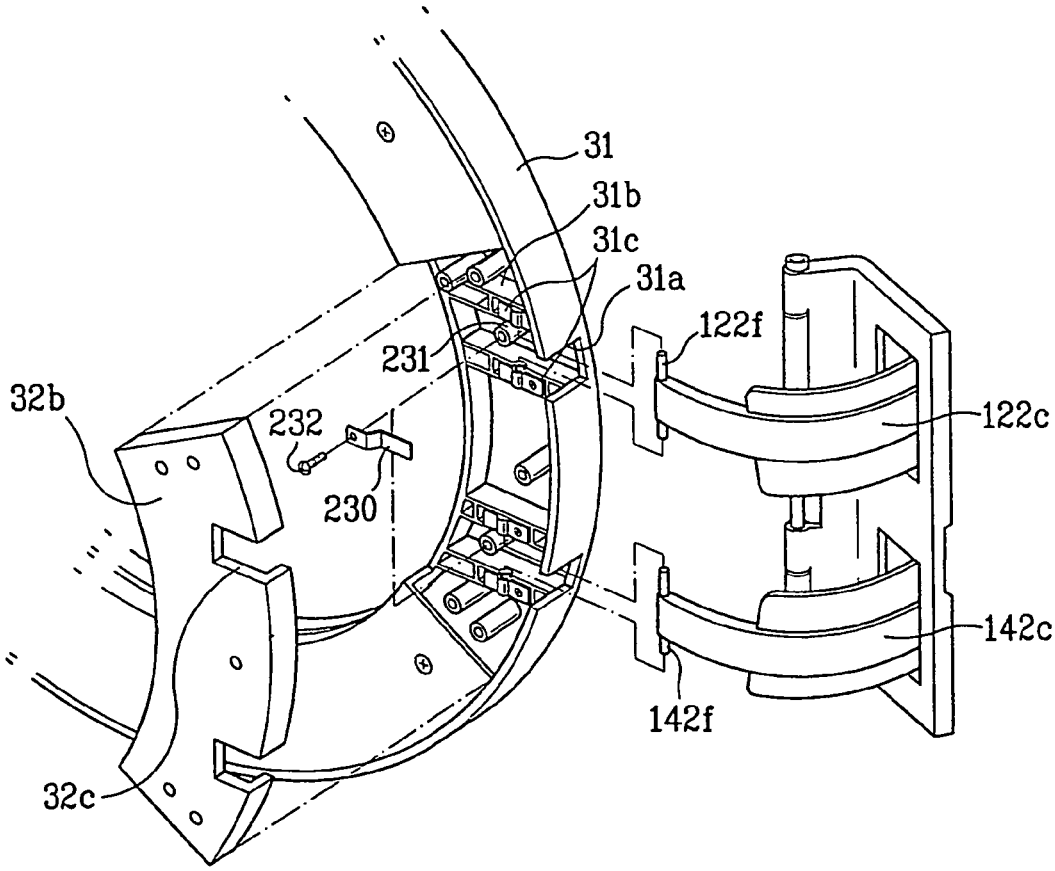
Figure 7C:
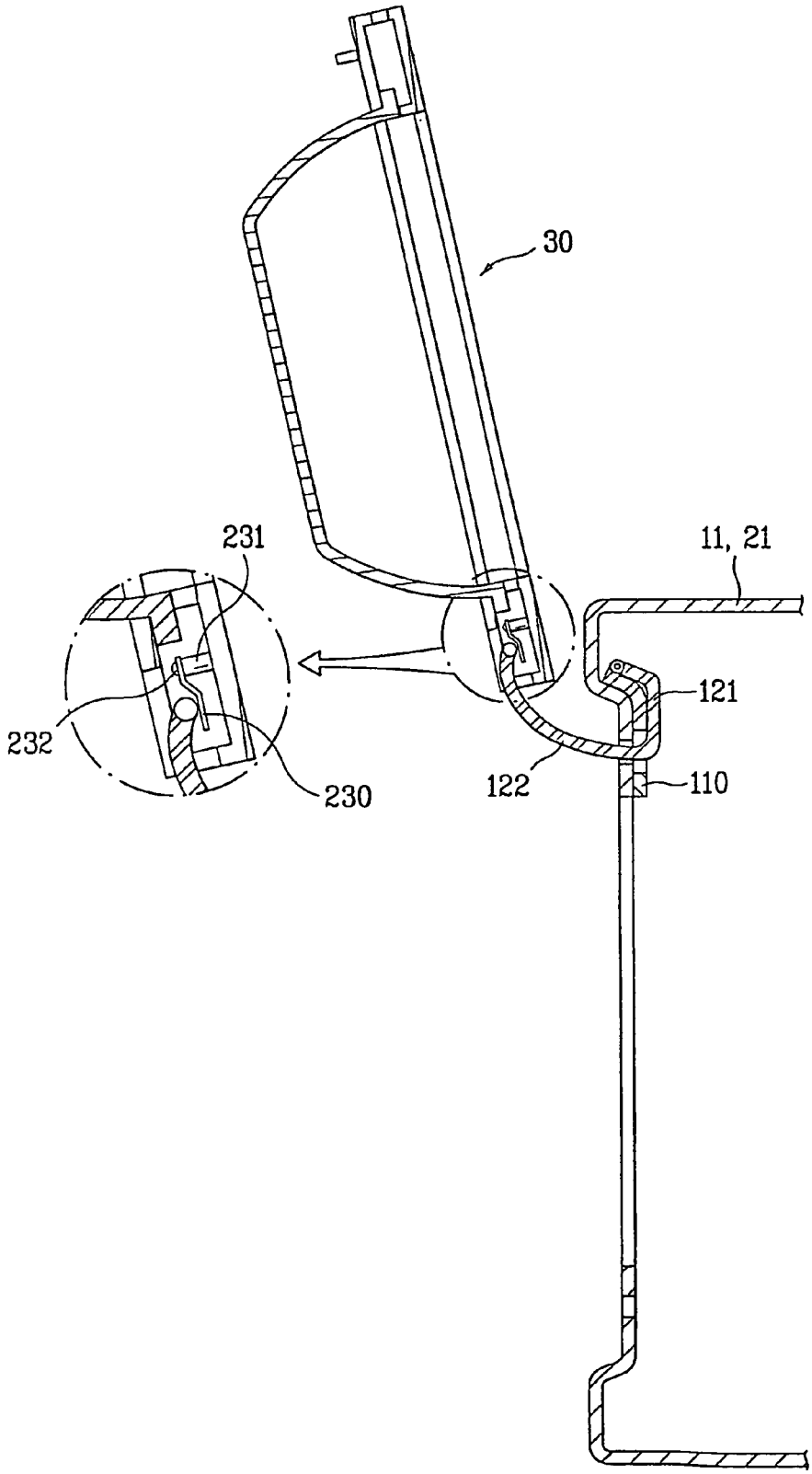
Figure 8A:
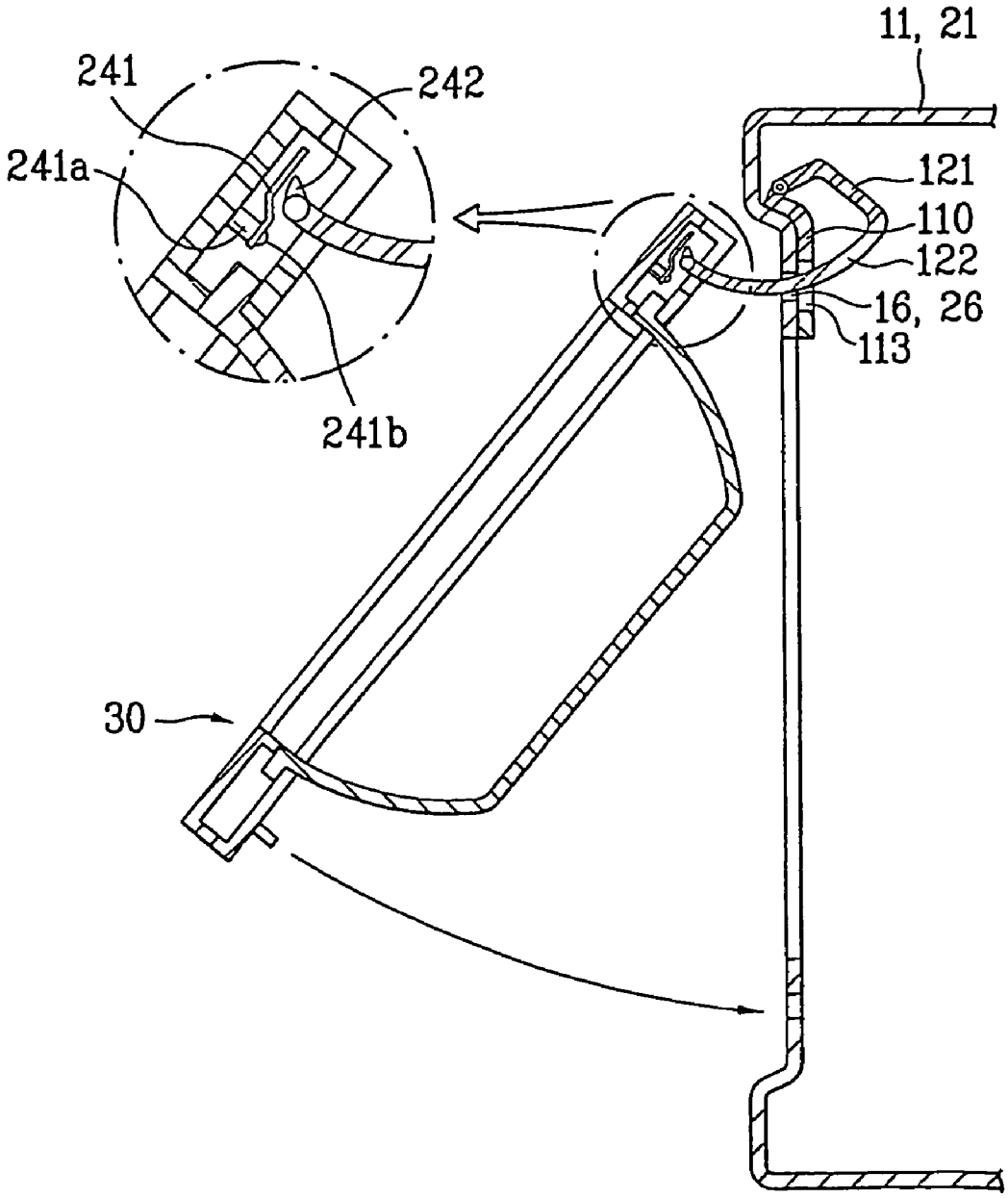
FIGS. 8A~8C illustrate partial sections and a perspective view each showing a variation of the second embodiment damping means of the door for washing machine and dryer in FIGS. 7A~7C.
Figure 8B:
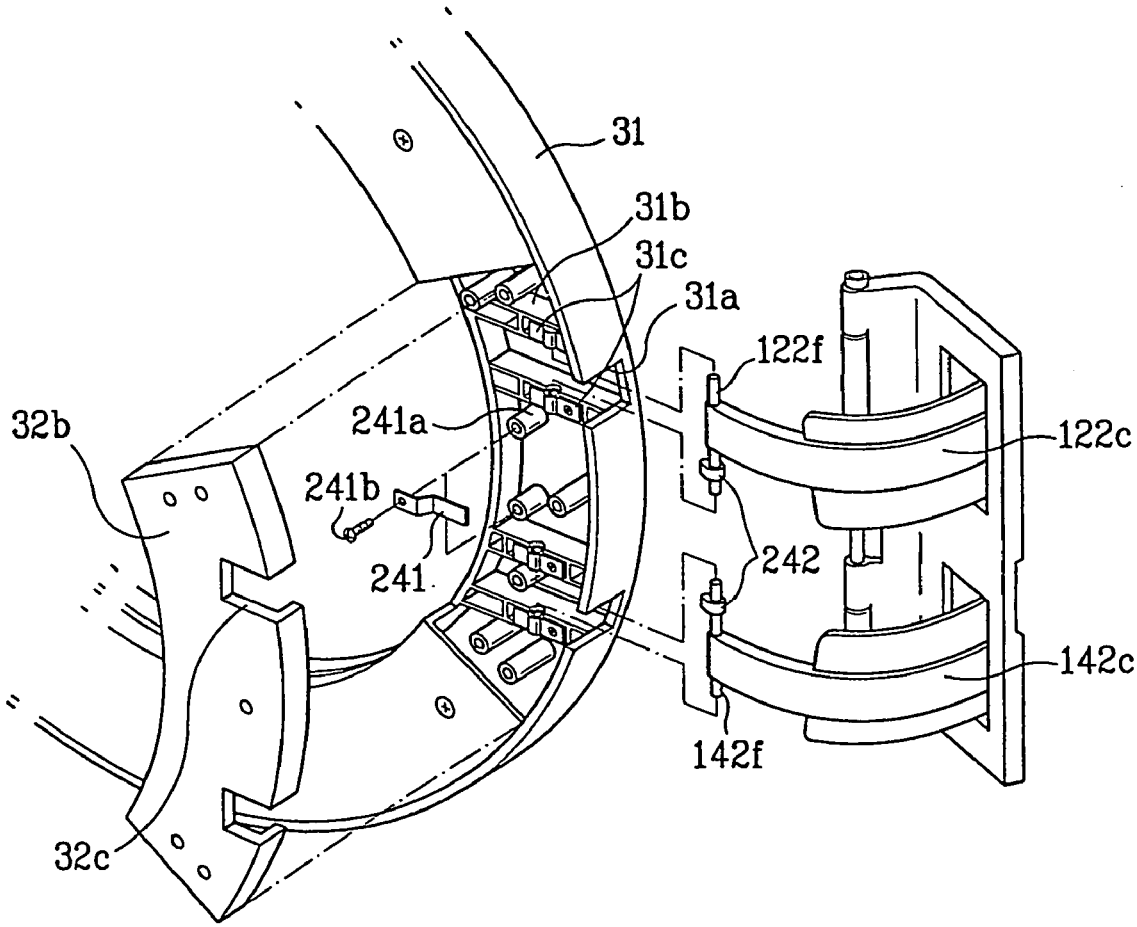
Figure 8C:
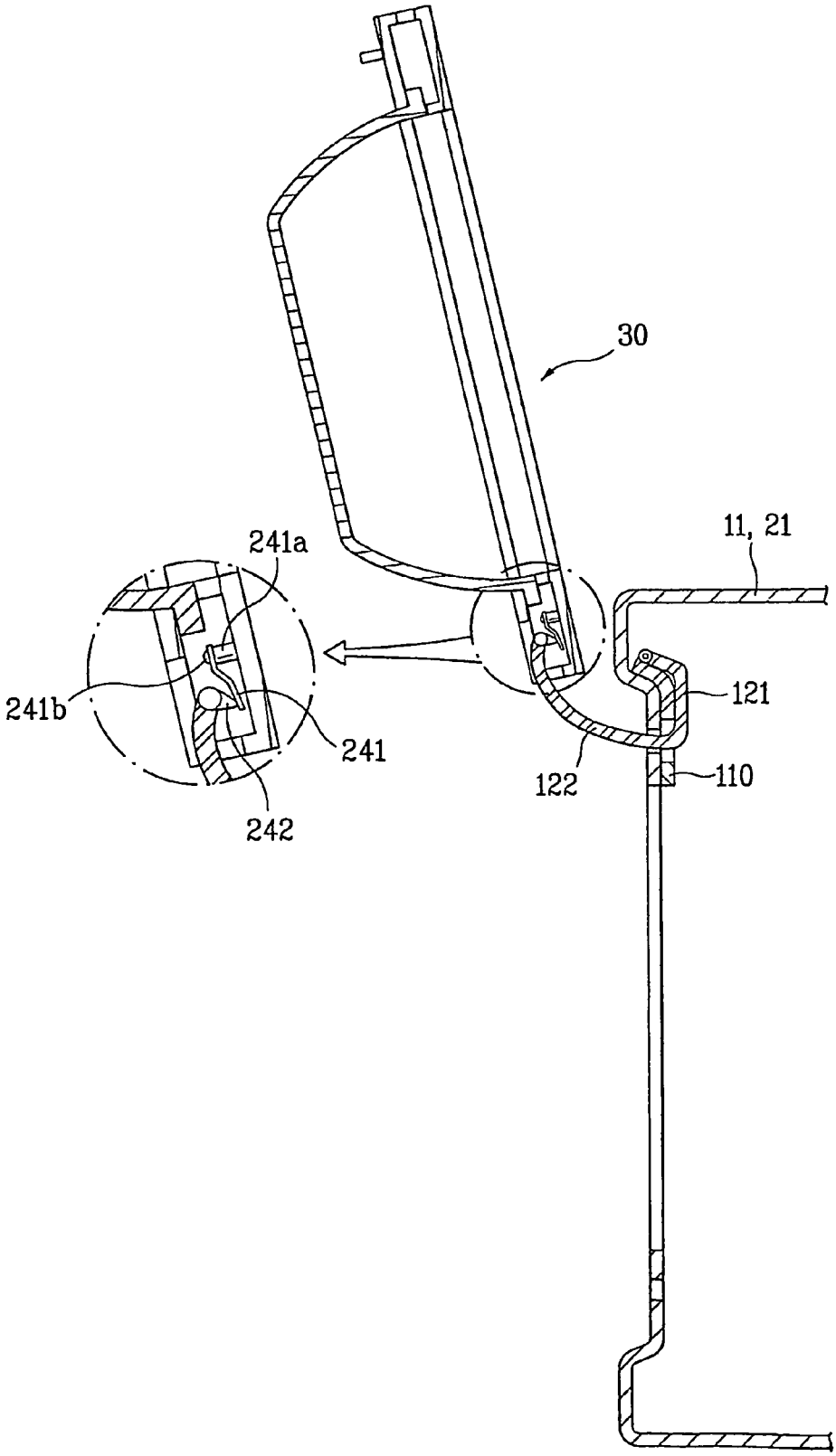

Referring to FIG. 7C, when the door 30 is opened, the second member 122 comes into contact with the plate spring elastically owing to the door 30 rotating relatively. Also, as shown in FIG. 8C, when the door 30 is opened, the plate spring 241 comes into contact with the cam 242 connected to the second member 122. According to this, the plate spring 230, or 241 is bent when the door 30 is opened, and restored when the door 30 is closed. Consequently, even if the door 30 is opened suddenly, the plate spring 230 or 242 is deformed by the second member 122 and the cam 242 and absorbs an impact. Moreover, the plate spring 230 or 242 suppresses excessive rotation of the door 30, enough to prevent the door 30, the housing 11 or 21 and the hinge assembly suffering from damage caused by the impact.

Meanwhile, as described, the hinge assembly 100 can rotatably support the door 30 only with one bracket 110 and one hinge arm 30. However, as shown in FIGS. 3A~3C, for making more stable supporting of the door 30, it is preferable that the hinge assembly includes another bracket 130 and another hinge arm 140. That is, such a hinge assembly 100 one pair of first and second brackets 110 and 130 connected to each other, and one pair of first and second hinge arms 120 and 140 rotatably connected to the first and second brackets 110 and 130. The second bracket 130 includes a first end 131 having a hole 131*a* and a second end 132 having a hub 132. In the second hinge arm 140, there are a first member 141 including a first end 141*a* having a hub 141*c* and a second end 141*b*, and a second member 142 including a first end 142*a*, a second end 142*b* having a second hinge shaft 142*f*, and a bar member 142*c*, and ribs 142*d* and 142*e*. In the hinge assembly, the hinge shaft 112*b* is shared. The second bracket and hinge arm 130 and 140 are identical to the first bracket and the hinge arm 110 and 120 described before. Moreover, though not described, it is understandable that other structures are also identical with the first bracket and the hinge arm 110 and 120. Accordingly, no additional description of the second bracket and hinge arm 130 and 140 will be given hereafter.

In the foregoing hinge assembly 100, for making more stable supporting of the door 30, it is required that a distance between connection points of the hinge arms 120 and 140 to the door 30 is great. That is, as shown in FIG. 4A, it is favorable that a distance between the bar members 122*c* and 142*c* are great as far as possible. As best shown in FIG. 3A, under the reason, the bar member 122*c* or 142*c* is spaced away from a longitudinal center line of the first member 121 or 141 outwardly. Owing to this, outer ribs 122*d* and 142*d* have widths different from inner ribs 122*e* and 142*e* respectively. In more detail, the widths of the outer ribs 122*d* and 142*d* symmetric to each other are the same, and the widths of the inner ribs 122*e* and 142*e* are the same too, and widths of opposite inner ribs 122*e* and 142*e* have widths greater than the widths of the outer ribs 122*d* and 142*d*.

Moreover, under various reasons, the hinge arms 120 and 140 can not be rotated, resulting to open or close the door 30, unstably. Therefore, the hinge assembly 100 further includes connection means for connecting the hinge arms 120 and 140.

Figure 9A:
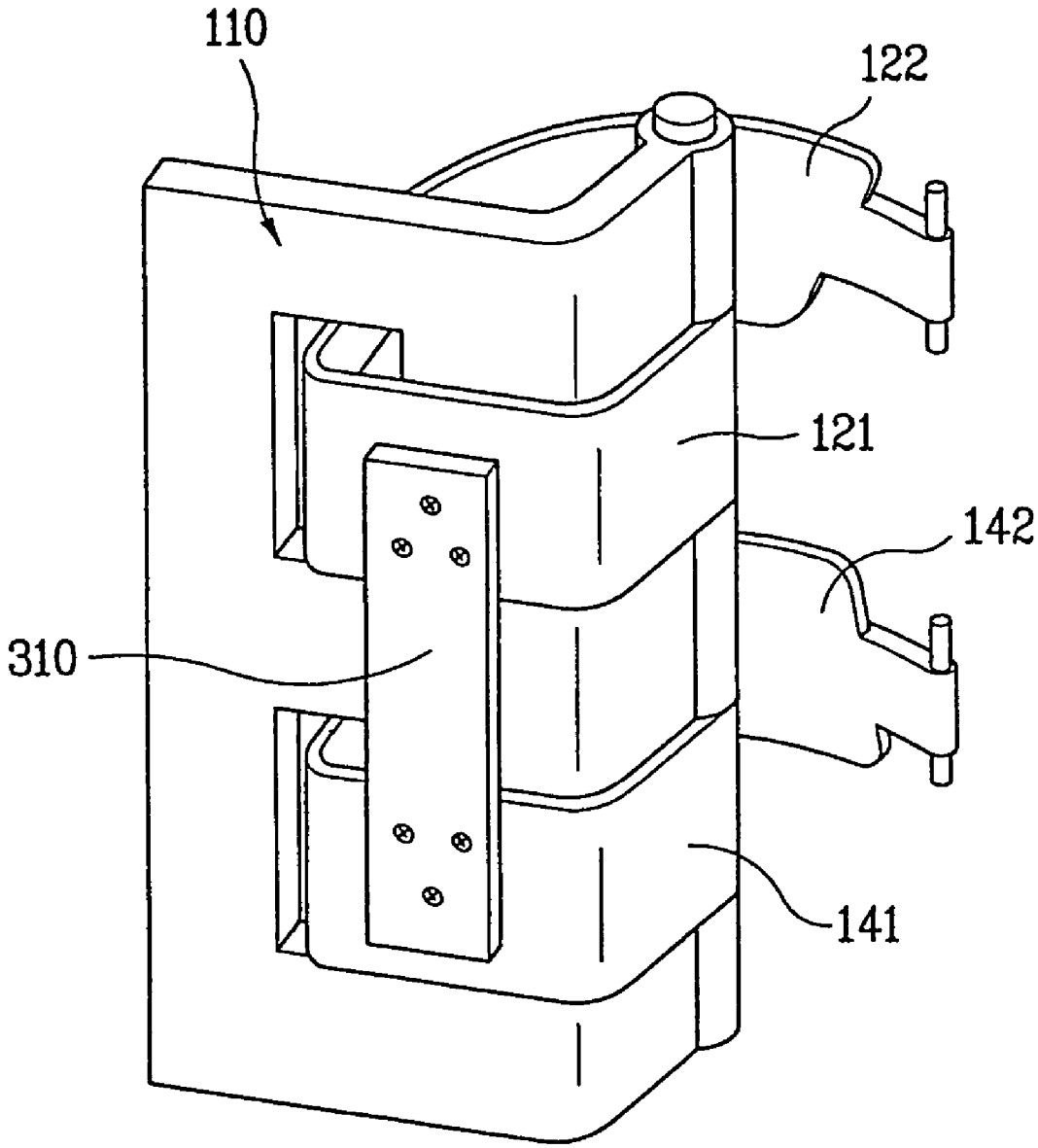
FIGS. 9A and 9B illustrate perspective views each showing first embodiment coupling means of a door for washing machine and dryer of the present invention.
Figure 9B:
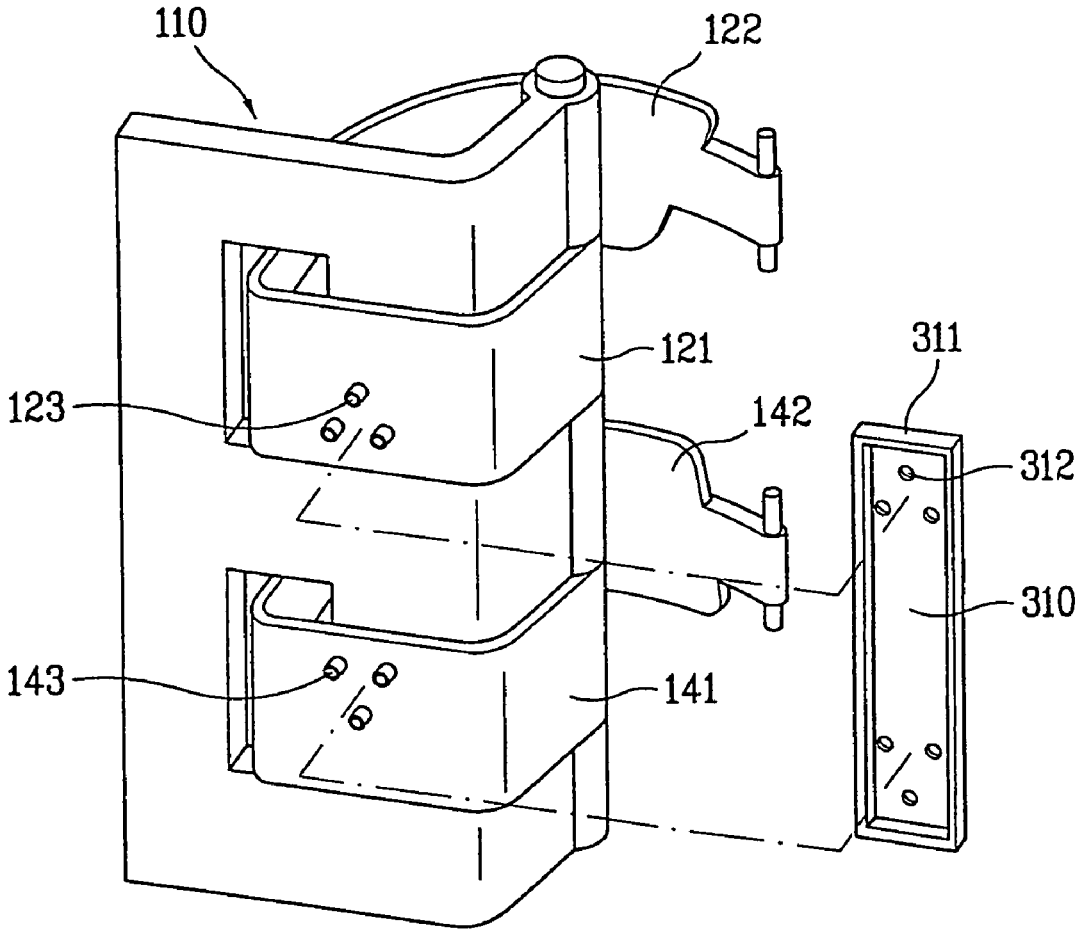

Referring to FIG. 9A, a first embodiment connection means is a plate member 310 connected between the first members 121 and 141 of the first and second hinge arms. As shown in FIG. 9B, the plate member 310 has a flange 311 extended from an edge thereof for reinforcing strength. There is at least one boss 123 or 143 on the first member 121 or 141. The plate member 310 has at least one hole 312 for fastening the plate member 310 to the boss 123 or 143 with fastener. It is required that the flange 311 is extended toward the first member 121 or 141 so as not to come into contact with the housing 11 or 21, and a height of the flange 311 is the same with, or lower than the boss 123 and 143.

Figure 10A:
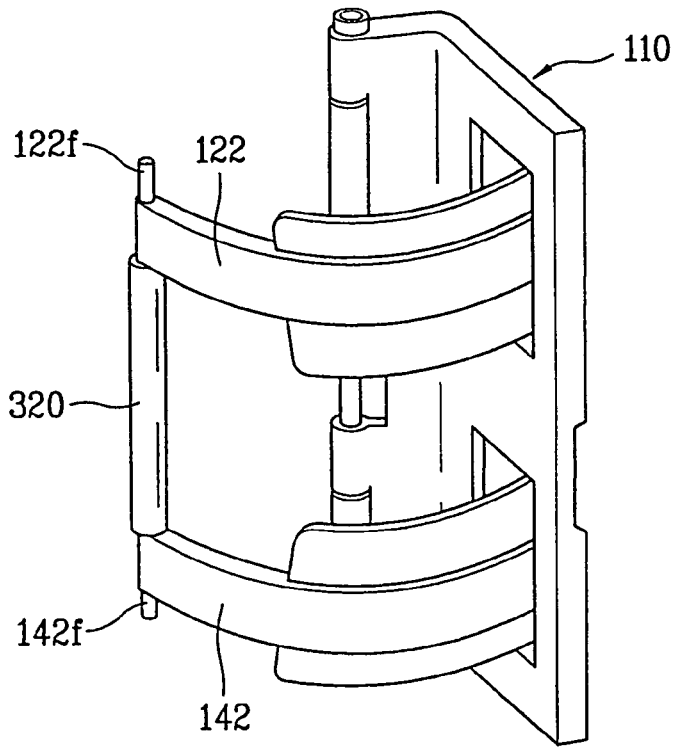
FIGS. 10A and 10B illustrate perspective views each showing second embodiment coupling means of a door for washing machine and dryer of the present invention.
Figure 10B:
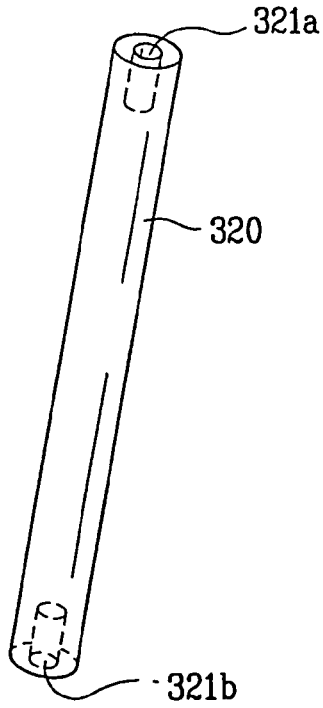
Figure 10C:
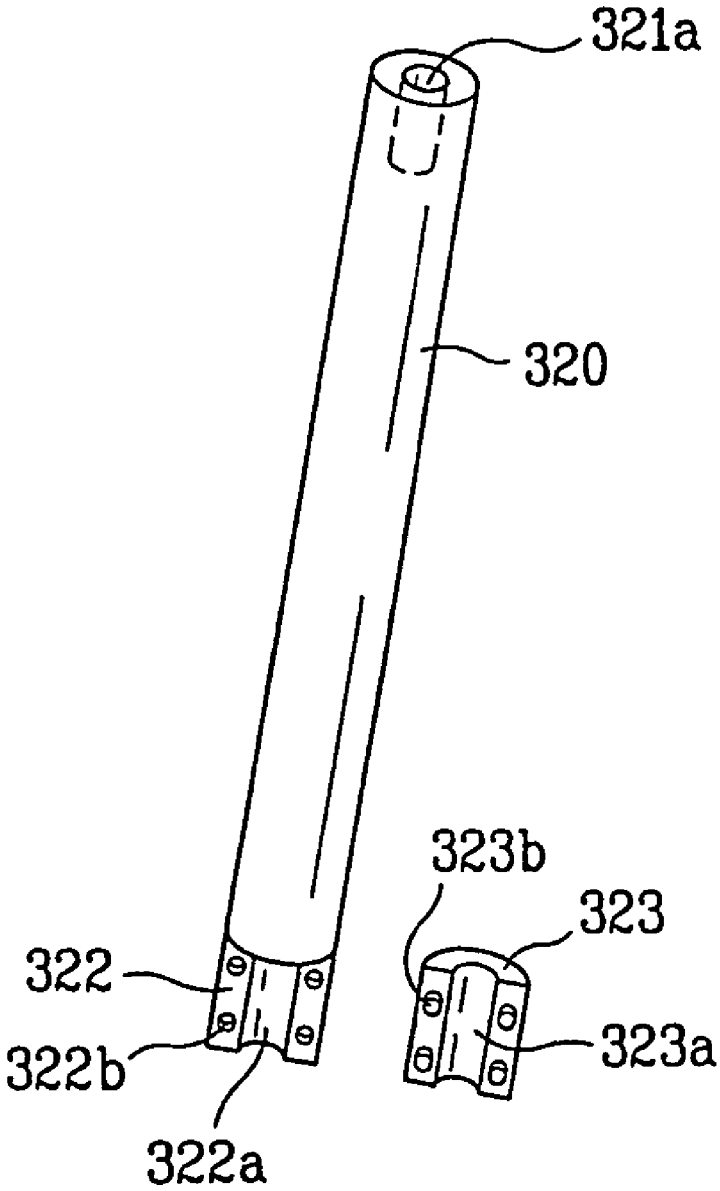
FIG. 10C illustrates a perspective view of a variation of the second embodiment coupling means in FIGS. 10A and 10B.

Referring to FIGS. 10A and 10B, a second embodiment connection means is a rod 320 connected between the second members 122 and 142. In more detail, the rod 320 connects the hinge shafts 122*f* and 142*f* of the second member. The rod 320 has hinge holes 321*a* and 321*b* at upper and lower ends thereof, for receiving opposite hinge shafts 122*f* and 142*f* respectively. It is required that the rod 320 is assembled with the hinge shafts 122*f* and 142*f* before the brackets 110 and 130 are assembled with the hinge arms 120 and 140. However, if a part of upper end or lower end of the rod 320 is detachable, the rod can be assembled/disassembled to/from the hinge shafts 122*f* and 142*f*. As shown in FIG. 10C, the upper or lower end of the rod 320 includes a first end 322 formed as one unit with a rod body, and a second end 323 detachably fastened to the first end 322. The first end 322 has a groove 322*a* for holding the hinge shaft 122*f* or 142*f*. The second end also has a groove 323*a*, so that the grooves 322*a* and 323*a* makes stable holding of the hinge shaft 122*f* or 142*f* when the first and second ends 322 and 323 are assembled. As shown, the first and second ends 322 and 323 are assembled, as pins 323*a* are press fit into holes 322*b*.

As described, the plate member 310 or the rod 320 is fastened to hold the hinge arms 120 and 140 together. Accordingly, the hinge arms 120 and 140 rotate at the same time, resulting to open/close the door 30 stably.

The operation of the door of the present invention will be explained, with reference to the attached drawings. FIGS. 11A~11D illustrate partial sections showing the steps of opening the door of the present invention, wherein a basic hinge assembly having single bracket 110 and hinge arm 120 is shown, and description of the operation of the door of the present invention will be given with respect to the basic hinge assembly. If the hinge assembly has the bracket 130 and the hinge arm 140 additionally, the operation of the additional bracket 130 and hinge arm 140 are the same with the bracket 110 and the hinge arm 120.

The user introduces the laundry into the washing machine or the dryer for washing or drying, and takes the laundry out of the washing machine or the dryer when the washing or drying is finished. In each of the cases, the user opens and closes the door 30 mounted to the housing 11 or 21.

Figure 11A:
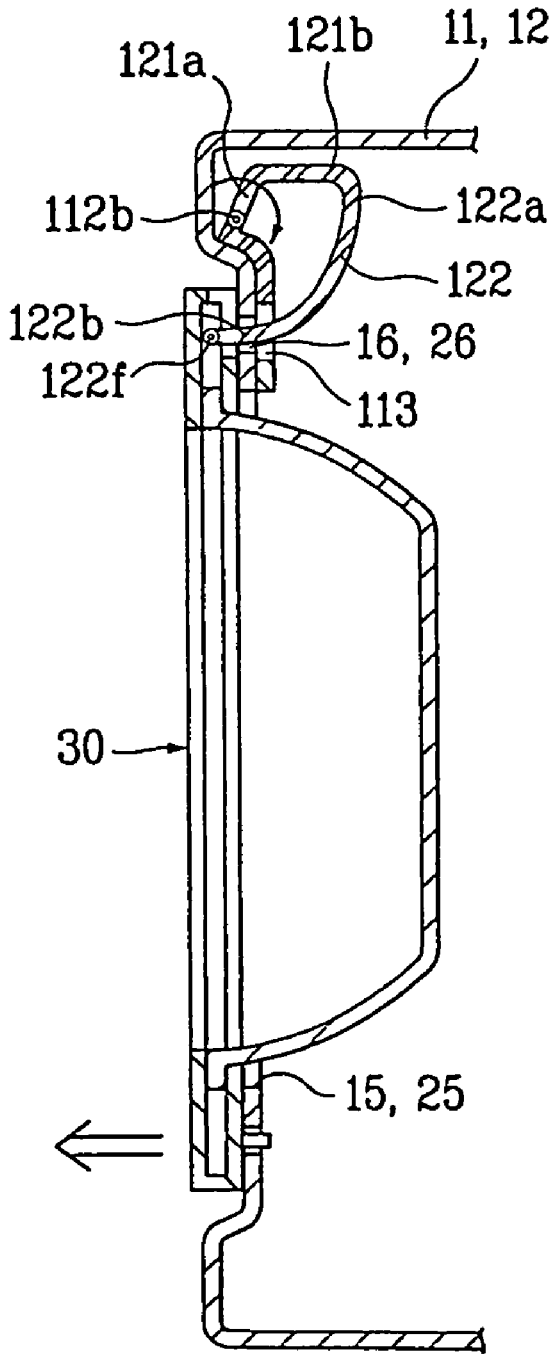
FIGS. 11A~11D illustrate partial sections showing the steps of opening the door of the present invention.
Figure 11B:
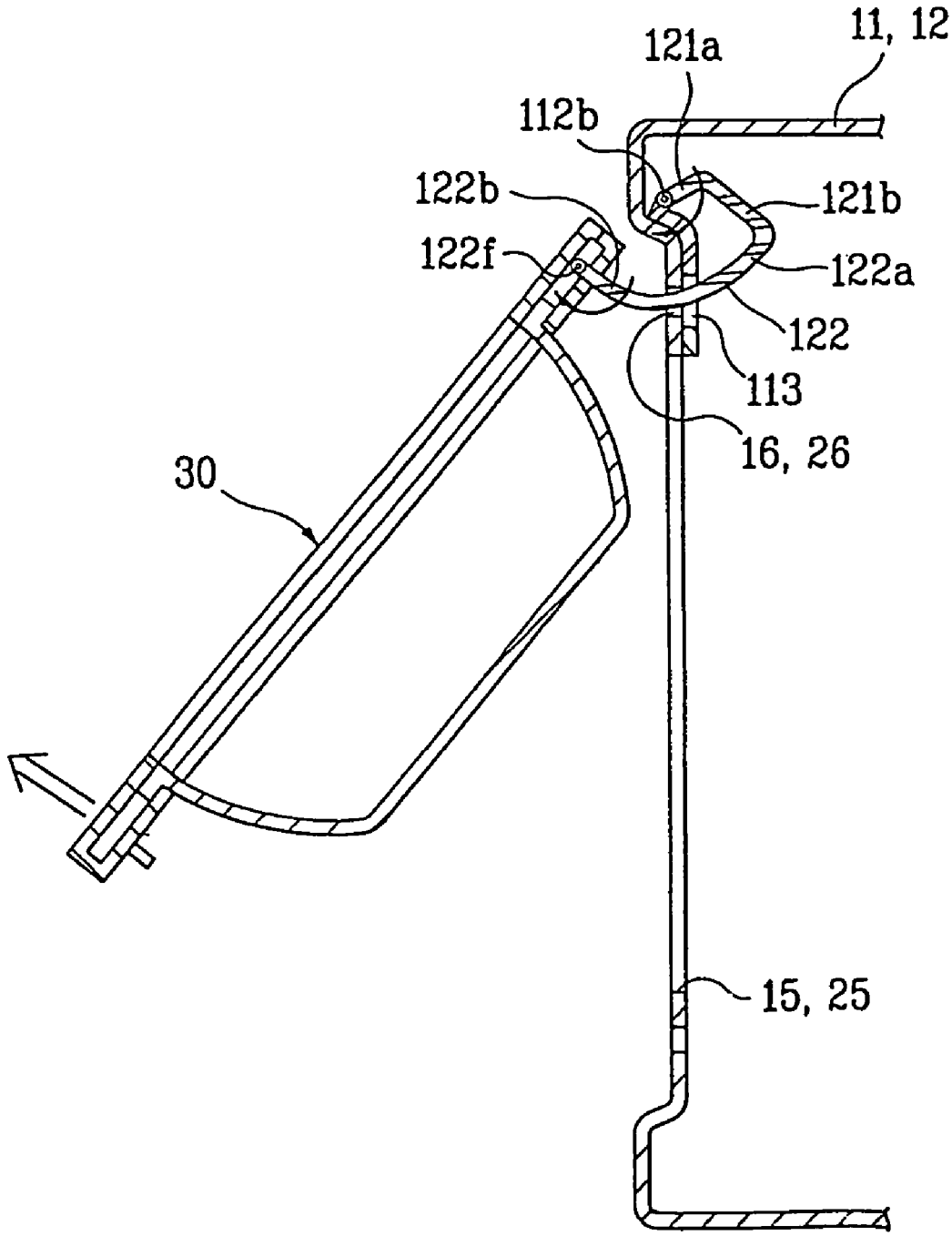

When the user opens the closed door 30 in FIG. 11A, the hinge arm 120 rotates with the door 30 connected thereto as shown in FIG. 11B. That is, the door 30 starts to rotate relative to the bracket 110 centered on the first hinge shaft 112*b*. At the same time with this, the second member 122 starts drawn out of the housing through the slot 113 in the bracket and the slot 16 or 26 in the housing. In during the rotation of the hinge arm 120, the door 30 slightly rotates relative to the hinge arm 120, i.e., the second member 122 centered on the second hinge shaft 122*f*.

Figure 11C:
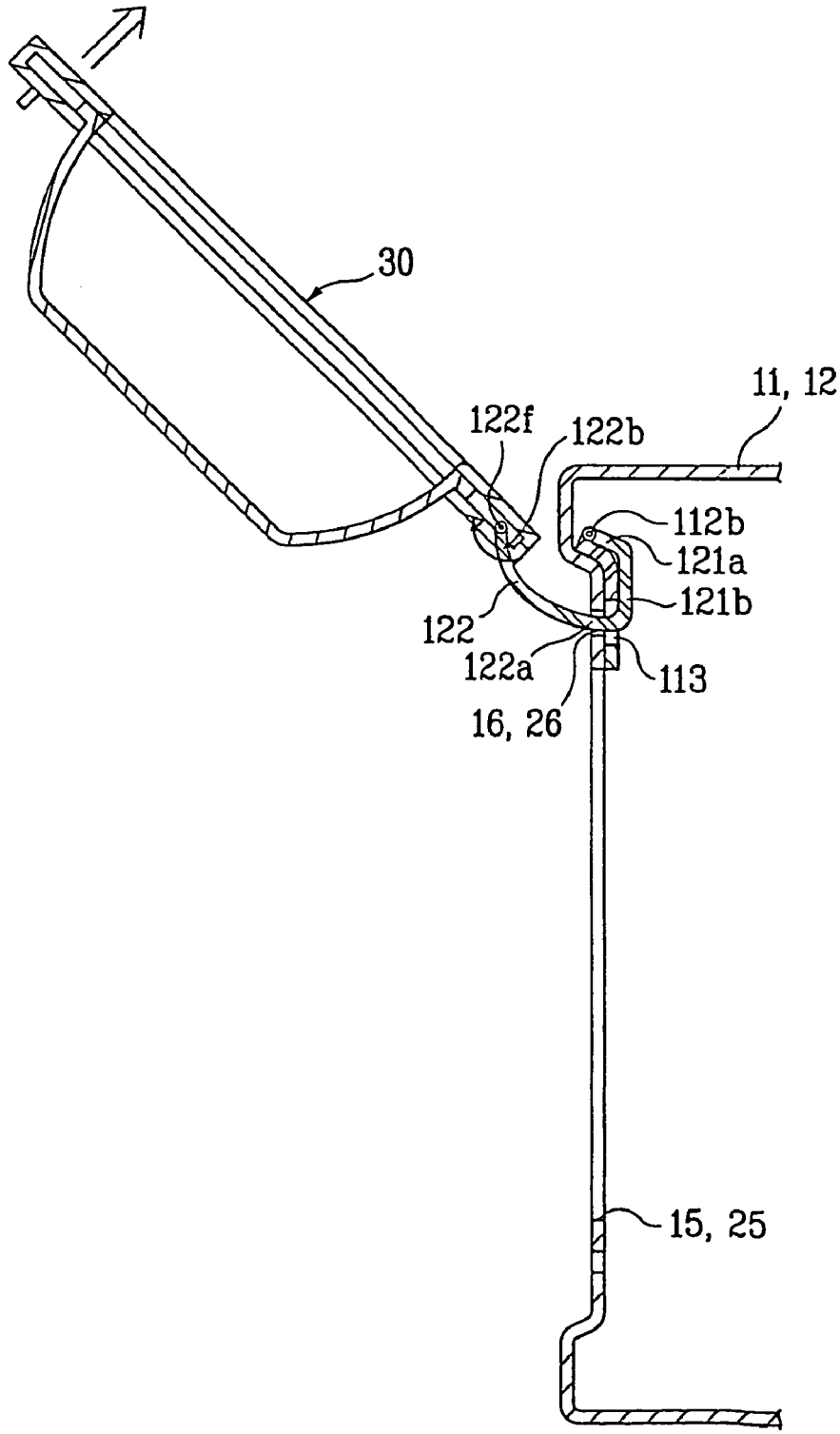

Then, referring to FIG. 11C, when the first member 121 is stopped by the bracket 110, the rotation of the hinge arm 120 is finished, resulting to open the door 30 at an angle ranging 120°~130° from the housing 11 or 21. When the hinge arm 120 is stopped by the bracket 110, the door 30 continues to rotate relative to the hinge arm, more precisely, to the second member 122, centered on the second hinge shaft 122*f*. Finally, as shown in FIG. 11D, the door 30 is opened up to 180° from the housing 130.

As described, the door 30 is rotated relative to the bracket 110 and the hinge arm 120, respectively. That is, the door 30 is rotated at preset angles centered on the first and second hinge shafts 112*b* and 122*f* respectively, the door 30 is rotated in two stages, actually. In the two stage rotation, the angle of rotation of the door 30 with respect to the first hinge shaft 112*b* is greater than the angle of rotation of the door 30 with respect to the second hinge shaft 112*f*. At the end, the door 30 is opened fully with respect to the housing 130 through the foregoing series of process.

Figure 11D:
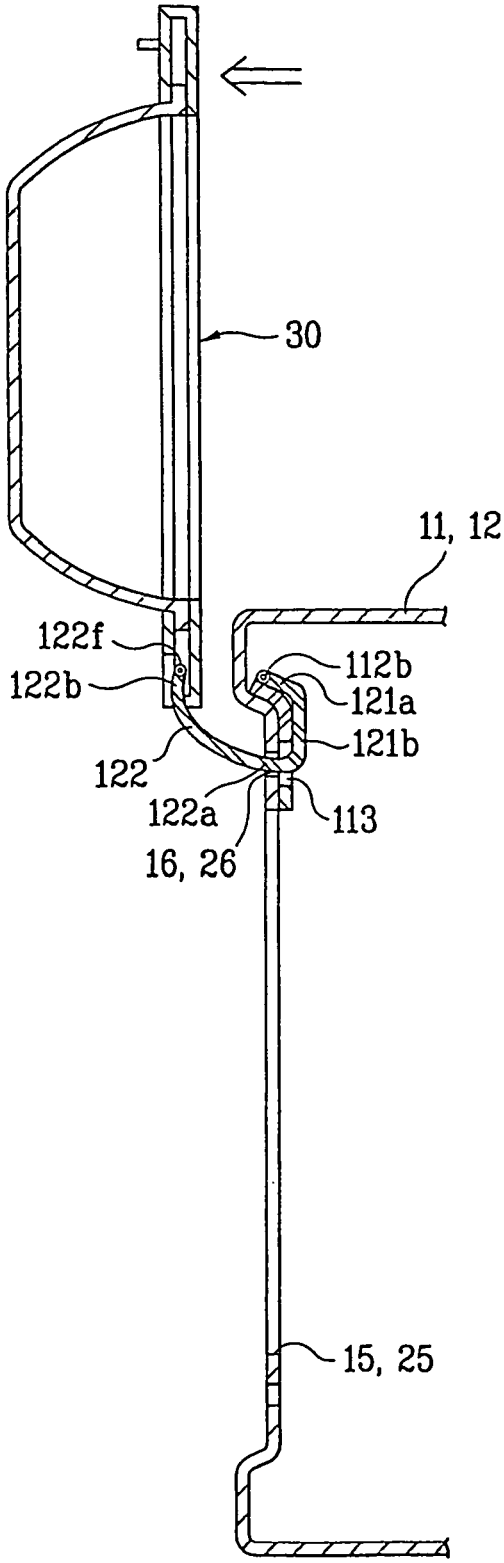

Referring to FIG. 11D, when the user closes the door 30, the closing process is carried out in reverse to the foregoing opening process. That is, the door 30 starts to rotate toward the housing 11 or 21 relative to the second member 122 centered around the second hinge shaft 122*f*. At the same time with this, the door 30 slightly rotates centered on the first hinge shaft 112*b* together with the hinge arm 120. Then, when the door 30 rotates no more centered on the second hinge shaft 122*f*, the door 30 and the hinge arm 120 continue to rotate centered on the first hinge 112*b*, until the door 30 is closed.

Meanwhile, the operation of the damping means 210, 220, 230 and 240 and the connection means 310 and 320 related to the door 30 are described before, no more description will be given.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The door for a washing machine and dryer rotates relative to the bracket, i.e., the housing, by a hinge assembly designed appropriately, and, in continuation, rotates relative to the hinge arm. According to this, the door is opened fully, to permit the user to introduce laundry into the washing machine and dryer, and take the laundry out of the washing machine and the dryer. In comparison to the related art door opened at a limited angle, the door of the present invention has no chances of being subjected to application of an excessive force since the door of the present invention is opened fully.

Moreover, the damping means in the door and hinge assembly prevents the door suffering form damage, and permits smooth opening and closing of the door. When a plurality of hinge arms are employed, the connection means connects the hinge arms to each other, thereby permitting stable open/close of the door.

What is claimed is:

1. A door for a washing machine or a dryer comprising:

a frame having a system for opening/closing an opening provided for introducing laundry into the washing machine or the dryer; and a hinge assembly including:

first and second brackets attached to an inside surface of the washing machine or the dryer, the first and second brackets having a hole at an end thereof for pass through engagement with a hinge shaft, and first and second hinge arms having a first member, the first member having a hole at an end for pass through engagement with the same hinge shaft to be rotatably connected to an end of the first and second brackets, and a second member extended in succession to the first member and rotatably connected to the frame for being drawn to an outside of the washing machine or the dryer, thereby enabling the door to be rotated relative to the first and second brackets and first and second hinge arms respectively, so as to be opened at an obtuse angle, and a rib extended from the second member in a direction defined along a rotational axis of the hinge shaft, for reinforcing the strength of the second member, wherein the second member is formed of a bar member having a width smaller than the first member and the rib is extended from the bar member, and wherein bar member of the second member of the first hinge arm and a bar member of a second member of the second hinge arm are spaced away outwardly from longitudinal center lines of the first members of the first and second hinge arms, and the first hinge arm and the second hinge arm have ribs with widths different from each other.

2. The door as claimed in claim 1, wherein the first includes bracket another end fixed to a housing of the washing machine or the dryer, and the end connected to the first member of the first hinge arm.

3. The door as claimed in claim 1, wherein the first bracket includes a guide slit for passing the second member.

4. The door as claimed in claim 3, wherein the housing includes a slit in communication to the guide slit formed at a position opposite to the guide slit.

5. The door as claimed in claim 4, wherein the slits are formed adjacent to the opening for introducing or taking the laundry into/out of the washing machine or dryer.

6. The door as claimed in claim 1, wherein the first member of the first hinge arm includes:

a first end rotatably connected to the first bracket; and a second end formed as one unit with the second member, the second end being opposite to the first end.

7. The door as claimed in claim 6, wherein the first bracket includes a coupling part of the first bracket and the first member includes:

a hub on the first bracket; and a hub at the first end of the first member;

wherein the hinge shaft inserted into the hubs in common connecting the hubs.

8. The door as claimed in claim 1, wherein the first member is rotated within a limited range, as the first member is stopped by the first bracket or the housing.

9. The door as claimed in claim 8, wherein the first member is flat.

10. The door as claimed in claim 1, wherein the first member is bent partly.

11. The door as claimed in claim 10, wherein the first member is bent toward an inside surface of the housing.

12. The door as claimed in claim 1, wherein the second member of the first hinge arm includes:

a first end connected to the first member as one unit; and a second end rotatably connected to the frame, the second end being opposite to the first end.

13. The door as claimed in claim 1, wherein the second member comprises a plate member extended from the first member vertical to the housing, the second member having a curvature.

14. The door as claimed in claim 13, wherein the second member is curved toward an opening direction of the door.

15. The door as claimed in claim 1, wherein the second member is inserted in the door.

16. The door as claimed in claim 15, wherein the second member is connected to an inside surface of an outer frame of the door.

17. The door as claimed in claim 16, wherein a coupling part of the second member and the outer frame includes:

a hinge shaft on the second member; and the first bracket is attached to the inside surface of the outer frame for rotatably receiving the hinge shaft.

18. The door as claimed in claim 17, wherein the second member is connected to the outer frame spaced away from the inside surface of the outer frame.

19. The door as claimed in claim 1, wherein the frame comprises an inner frame joined with the outer frame, wherein at least one of the inner frame and the outer frame has a cut away part for enabling the second member to make relative rotation with respect to the door.

20. The door as claimed in claim 19, wherein the outer frame has a supplementary cut away part connected to the cut away part for enabling the second member to make relative rotation with respect to the door.

21. The door as claimed in claim 1, wherein the rib is spaced a predetermined distance from the door.

22. The door as claimed in claim 21, wherein an end of the rib adjacent to the door is sloped in conformity with an outer shape of the door.

23. The door as claimed in claim 15, wherein a part of the frame adjacent to the second member is detachable for easy connection to the second member.

24. The door as claimed in claim 23, wherein the frame comprises an inner frame and an outer frame, the inner frame includes:

a main frame; and a subframe separable from the main frame, the subframe being adjacent to the connection part of the second member.

25. The door as claimed in claim 1, wherein the hinge assembly further includes a damping means for absorbing an impact occurred at the door.

26. The door as claimed in claim 25, wherein the damping means supports the first member, elastically.

27. The door as claimed in claim 26, wherein the damping means is an elastic member adjacent to the first member attached to the housing so as to come into contact with the first member.

28. The door as claimed in claim 27, wherein the elastic member is sponge, a compression spring, or rubber.

29. The door as claimed in claim 26, wherein the damping means is an elastic member fitted to a coupling part of the first member and the first and second brackets.

30. The door as claimed in claim 29, wherein the elastic member is a spring having one end supported on the first member, and the other end supported on the first and second brackets, and inserted by the hinge shaft together with the first member and the first and second brackets.

31. The door as claimed in claim 25, wherein the damping means supports the second member, elastically.

32. The door as claimed in claim 31, wherein the damping means is a plate spring between the second member and the door frame.

33. The door as claimed in claim 31, wherein the damping means includes; a plate spring fitted to the door frame adjacent to the second member, and a cam fitted to the second member so as to come into contact with the plate spring when the door is rotated.

34. The door as claimed in claim 1, wherein the widths of the ribs of the first hinge arm and second hinge arm are symmetric to each other and identical.

35. The door as claimed in claim 1, wherein the widths of the ribs of the first hinge arm and second hinge arm opposite to each other are larger than the widths of other ribs.

36. The door as claimed in claim 1, wherein the hinge assembly further includes connection means for restraining the first and second hinge arms to each other.

37. The door as claimed in claim 36, wherein the connection means is a plate member connecting the first members of the first and second hinge arms.

38. The door as claimed in claim 37, wherein the plate member includes a flange formed at an edge thereof.

39. The door as claimed in claim 38, wherein a connection part of the plate member and the first hinge arms includes:

bosses on the first member;

holes in the plate member in correspondence to the bosses; and fastening members fastened to the holes.

40. The door as claimed in claim 36, wherein the connection means is a rod for connecting the hinge shafts formed on the second members of the first and second hinge arms.

41. The door as claimed in claim 40, wherein the rod includes hinge holes at top and bottom ends thereof for receiving opposite hinge shafts of the second members.

42. The door as claimed in claim 41, wherein the top or bottom ends of the rod is detachable.

43. The door as claimed in claim 42, wherein the rod includes;

a first end formed as one unit with the rod, the first end having a groove for holding the hinge shaft, and a second end detachably fastened to the first end, the second end having a groove for receiving the hinge shaft together with the groove in the first end.

44. A washing machine comprising:

a housing;

a tub in the housing for storage of washing water;

a drum rotatably mounted in the tub for washing laundry;

a door including:

a frame having a system for opening/closing an opening provided for introducing the laundry into the drum, and a hinge assembly including:

first and second brackets attached to an inside surface of the housing, the first and second brackets having a hole at an end thereof for pass through engagement with a hinge shaft;

first and second hinge arms with a first member, the first member having a hole at an end for pass through engagement with the same hinge shaft to be rotatably connected at an end of the first and second brackets;

a second member extended in succession to the first member and rotatably connected to the frame for being drawn to an outside of the housing, thereby enabling the door to be rotated relative to the first and second brackets and the first and second hinge arms respectively, so as to be opened at an obtuse angle; and a rib extended from the second member in a direction defined along a rotational axis of the hinge shaft, for reinforcing the strength of the second member, wherein the second member is formed of a bar member having a width smaller than the first member and the rib is extended from the bar member, and wherein bar member of the second member of the first hinge arm and a bar member of a second member of the second hinge arm are spaced away outwardly from longitudinal center lines of the first members of the first and second hinge arms, and the first hinge arm and the second hinge arm have ribs with widths different from each other.

45. A dryer comprising:

a housing;

a drum rotatably mounted in the housing for drying laundry;

a heating device mounted in the housing for supplying hot air to the drum; and a door including:

a frame having a system for opening/closing an opening provided for introducing the laundry into the drum, and a hinge assembly having:

first and second brackets attached to an inside surface of the housing the first and second brackets having a hole at an end of the first and second brackets for pass through engagement with a hinge shaft;

first and second hinge arms with a first member, the first member having a hole at an end for pass through engagement with the same hinge shaft to be rotatably connected at an end of the first and second brackets;

a second member extended in succession to the first member and rotatably connected to the frame for being drawn to an outside of the housing, thereby enabling the door to be rotated relative to the first and second brackets and the first and second hinge arms respectively, so as to be opened at an obtuse angle; and a rib extended from the second member in a direction defined along a rotational axis of the hinge shaft, for reinforcing the strength of the second member, wherein the second member is formed of a bar member having a width smaller than the first member and the rib is extended from the bar member, and wherein bar member of the second member of the first hinge arm and a bar member of a second member of the second hinge arm are spaced away outwardly from longitudinal center lines of the first members of the first and second hinge arms, and the first hinge arm and the second hinge arm have ribs with widths different from each other.

* * * * *